US006949496B1

(12) United States Patent
Boutique et al.

(10) Patent No.: US 6,949,496 B1
(45) Date of Patent: Sep. 27, 2005

(54) DETERGENT COMPOSITIONS COMPRISING HYDROTROPES

(75) Inventors: Jean-Pol Boutique, Gembloux (BE); Walter August Maria Broeckx, Zele (BE); Steven Jozef Louis Coosemans, Kampenhout (BE); Lorenzo Matteo Pierre Gualco, Bruxelles (BE); James Pyott Johnston, Merchtem (BE); Eric Tcheou, Bruxelles (BE); David William Ingram, Brussel (BE)

(73) Assignee: The Procter & Gamble Company, Cincinnati, OH (US)

( * ) Notice: Subject to any disclaimer, the term of this patent is extended or adjusted under 35 U.S.C. 154(b) by 207 days.

(21) Appl. No.: 10/048,081

(22) PCT Filed: Aug. 8, 2000

(86) PCT No.: PCT/US00/21570

§ 371 (c)(1),
(2), (4) Date: Jan. 24, 2002

(87) PCT Pub. No.: WO01/10993

PCT Pub. Date: Feb. 15, 2001

Related U.S. Application Data

(60) Provisional application No. 60/148,056, filed on Aug. 10, 1999, provisional application No. 60/150,233, filed on Aug. 23, 1999, provisional application No. 60/156,339, filed on Sep. 27, 1999, provisional application No. 60/156,340, filed on Aug. 27, 1999, and provisional application No. 60/188, 123, filed on Mar. 9, 2000.

(51) Int. Cl.[7] ..... C11D 3/20; C11D 3/43; D06L 1/00

(52) U.S. Cl. ..... 510/276; 510/338; 510/342; 510/407; 510/418; 510/505; 8/137

(58) Field of Search ..... 510/276, 338, 510/342, 407, 418, 505, 411, 446; 8/137

(56) References Cited

U.S. PATENT DOCUMENTS

| | | | | | |
|---|---|---|---|---|---|
| 4,737,314 | A | * | 4/1988 | Yokoyama et al. | 510/421 |
| 4,769,172 | A | * | 9/1988 | Siklosi | 510/407 |
| 4,873,012 | A | | 10/1989 | Broze et al. | 510/304 |
| 5,747,443 | A | * | 5/1998 | Wahl et al. | 510/515 |
| 5,759,975 | A | * | 6/1998 | Maxwell | 510/203 |
| 5,759,981 | A | | 6/1998 | Boutique et al. | 510/304 |
| 5,759,990 | A | * | 6/1998 | Wahl et al. | 510/515 |
| 5,814,592 | A | | 9/1998 | Kahn et al. | 510/304 |
| 5,872,092 | A | | 2/1999 | Kong-Chan et al. | 510/413 |
| 5,877,145 | A | * | 3/1999 | Wahl et al. | 510/515 |
| 5,945,392 | A | | 8/1999 | Boutique et al. | 510/372 |
| 5,977,055 | A | * | 11/1999 | Trinh et al. | 510/515 |
| 6,093,691 | A | * | 7/2000 | Sivik et al. | 510/515 |
| 6,165,959 | A | | 12/2000 | Meyer et al. | 510/311 |
| 6,207,634 | B1 | | 3/2001 | Meyer et al. | 510/371 |
| 6,239,094 | B1 | | 5/2001 | Goderis et al. | 510/357 |
| 6,277,804 | B1 | * | 8/2001 | Kahn et al. | 510/321 |
| 6,281,187 | B1 | | 8/2001 | Smerznak | 510/418 |
| 6,376,455 | B1 | * | 4/2002 | Friedli et al. | 510/515 |
| 6,458,343 | B1 | * | 10/2002 | Zeman et al. | 424/63 |
| 6,521,797 | B1 | * | 2/2003 | Anderson et al. | 568/448 |
| 6,770,613 | B2 | * | 8/2004 | Aouad et al. | 510/407 |
| 6,790,818 | B2 | * | 9/2004 | Borgonjon et al. | 510/235 |

FOREIGN PATENT DOCUMENTS

| | | | | |
|---|---|---|---|---|
| WO | WO 96/11572 | * | 4/1996 | C11D/7/26 |
| WO | WO 96/33800 | | 10/1996 | |
| WO | WO 97/00938 | | 1/1997 | |
| WO | WO 98/12293 | * | 3/1998 | C11D/3/00 |
| WO | WO 98/47991 | * | 10/1998 | C11D/1/62 |
| WO | WO 98/53035 | | 11/1998 | |

* cited by examiner

*Primary Examiner*—Lorna M. Douyon
(74) *Attorney, Agent, or Firm*—Armina E. Matthews; Brahm J. Corstanje; Kim William Zerby

(57) ABSTRACT

The present invention relates to detergent compositions, especially liquid, granular and tablet forms of laundry detergent compositions, that comprise improved hydrotropes, wherein the hydrotropes are organic molecules in which two polar groups are separated from each other by at least 5 aliphatic carbon atoms; liquid compositions that contain such hydrotropes have a viscosity, dilution profile and dissolution behavior that render the product effective and convenient for use as a liquid laundry detergent composition.

8 Claims, No Drawings

DETERGENT COMPOSITIONS COMPRISING HYDROTROPES

This appl. is a 371 of PCT/US00/21570 Aug. 8, 2000 which claims benefit of provisional appl. 60/148,056, Aug, 10, 1999 and claims benefits of provisional 60/150,233 Aug. 23, 1999, which claims benefit of provisional 60/156,339 Sep. 27, 1999 which claims benefit of provisional 60/156, 340 Aug. 27, 1999 which claims benefit of provisional 60/188,123 Mar. 9, 2000.

FIELD OF THE INVENTION

The present invention relates to detergent compositions, especially liquid, granular and tablet forms of laundry detergent compositions, that comprise improved hydrotropes, wherein the hydrotropes are organic molecules in which two polar groups are separated from each other by at least 5 aliphatic carbon atoms; liquid compositions that certain such hydrotropes have a viscosity, dilution profile and dissolution behavior that render the product effective and convenient for use as a liquid laundry detergent composition.

BACKGROUND OF THE INVENTION

In recent years, the popularity of detergent products is forms other than granular/powder has increased. These other forms include liquids and tables.

Liquid laundry detergent products offer a number of advantages over dry, powdered or particulate laundry detergent products. Liquid laundry detergent products are readily measurable, speedily dissolved in wash water, non-dusting, are capable of being easily applied in concentrated solutions or dispersions to soiled areas on garments to be laundered and usually occupy less storage space than granular products. Additionally, liquid laundry detergents may have incorporated into their formulations materials which would deteriorate in the drying operations employed in the manufacture of particulate or granular laundry detergent products. Because liquid laundry detergents are usually considered to be more convenient to use than granular laundry detergents, they have found substantial favor with consumers.

Despite the advantages of liquid detergent compositions, granular products retain numerous advantages. These advantages include performance, formulation capability, lower-cost packaging and higher product stability. The advantages of product stability and formulation capability are derived in large from the nature granular admixtures where components can be individually stabilized and isolated into particles before being admixed with other particles. This physical separation in the final detergent composition allows the use of materials that are potentially unstable in a composition such as bleaches, enzymes, etc.

It is well-known to make detergent compositions in tablet form by compacting a granular detergent composition. Such tablets offer the convenience to consumers of pre-measured detergent dosage without the inconvenience and untidiness of measuring a sufficient amount of a granular detergent composition for each wash. Such products also offer considerable convenience to those consumers who launder the clothes outside or away from their residence (e.g. at a laundromat) because the consumer is required to transport only precisely as much laundry detergent as she or he needs for clothes laundering. Detergent compositions may be made in tablet form by compacting detergent particulates.

A disadvantage with conventional liquid detergent compositions has been compatibility of ingredients. Laundry detergent components which may be compatible with each other in granular and/or tablet products, may tend to interact or react with each other in a liquid, especially in an aqueous liquid environment.

A disadvantage with conventional granular/powder detergent compositions has been relatively poor dissolution, dispersion and solubility performance.

A disadvantage with conventional tablet detergent compositions has been the conflict between making the tablets sufficiently strong and durable to avoid breaking apart during manufacture, transportation and/or storage, while at the same time making the tablets in a manner such that the tablets rapidly disintegrate upon contact with wash water.

Given the foregoing, there is a continuing need to provide/formulate liquid detergent compositions which have not only excellent cleaning performance and compositional and physical stability but which also have a viscosity, dilution profile and dissolution behavior that render them useful and convenient for use as a liquid laundry detergent composition; there is a continuing need to provide/formulate granular/powder detergent compositions which have improved dissolution, dispersion and solubility performance while maintaining the granular/powder detergent's inherent formulation flexibility; and there is a continuing need to provide/formulate tablet detergent compositions which are both strong and durable to resist breakage during manufacture, transportation and/or storage, and which also disintegrate rapidly upon contact with wash water so that the components of the tablet can provide detersive benefits during the wash process.

SUMMARY OF THE INVENTION

It has now been discovered in the present invention that the addition of certain hydrotropes to the detergent compositions of the present invention, such as aqueous or non-aqueous liquid laundry detergent compositions, granular/powder laundry detergent compositions and/or tablet laundry detergent compositions, provides 1) a liquid detergent product that has a viscosity, dilution profile and dissolution behavior that render the product useful and convenient as a liquid laundry detergent composition, and/or 2) a granular/powder detergent product having improved dispersion, dissolution and/or solubility performance with the need to reduce surfactant levels compared to granular/powder detergent products that lack such hydrotropes, and/or 3) a tablet detergent product, wherein the hydrotropes are useful as binding agents, having improved strength and durability properties with excellent disintegration and dissolution properties compared to tablet detergent products that lack such hydrotropes.

A. Liquid Products

The liquid detergent products containing these hydrotropes demonstrate excellent cleaning performance, excellent compositional and physical stability and favorable product rheological behavior. These certain hydrotropes may be most generally classified as organic molecules in which two polar groups are separated from each other by at least 5 aliphatic carbon atoms.

The liquid detergent products may be aqueous or non-aqueous. In a preferred aspect of the present invention a nonaqueous liquid detergent comprising a hydrotrope having two polar groups separated from each other by at least 5 aliphatic carbon atoms as well as from about 49% to about 99.95% by weight of the composition of a surfactant-containing non-aqueous liquid phase and from about 1% to about 50% by weight of the composition of particulate material which is substantially insoluble in said liquid phase and which is selected from peroxygen bleaching agents, bleach activators, organic detergent builders, inorganic alkalinity sources and combinations thereof, is provided.

B. Granular/Powder Products

The granular/powder detergent products containing these hydrotropes demonstrate improved dispersion, dissolution and/or solubility performance with the need to reduce surfactant levels compared to granular/powder detergent products that lack such hydrotropes. These hydrotropes may be most generally classified as an organic molecule which has a first polar group and a second polar group separated from each other by at least 5 aliphatic carbon atoms.

C. Tablet Products

The detergent tablets prepared according to the present invention comprise a hydrotrope ("binding agent") characterized in that the binding agent may be most generally classified as an organic molecule which has a first polar group and a second polar group separated from each other by at least 5 aliphatic carbon atoms. The tablet detergent products exhibit improved strength and durability properties with excellent disintegration and dissolution properties compared to tablet detergent products that lack such hydrotropes.

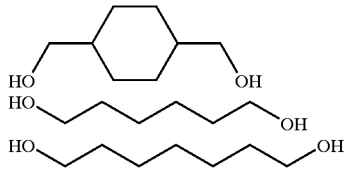

All parts, percentages and ratios used herein are expressed as percent weight unless otherwise specified. All documents cited are, in relevant part, incorporated herein by reference.

DETAILED DESCRIPTION OF THE INVENTION

Definitions

"Hydrotrope"—As used herein, "hydrotrope" generally means a compound with the ability to increase the solubilities, preferably aqueous solubilities, of certain slightly soluble organic compounds, more preferably "hydrotrope" is defined as follows (see S. E. Friberg and M. Chiu, J. Dispersion Science and Technology, 9(5&6), pages 443 to 457, (1988–1989)):

1. A solution is prepared comprising 25% by weight of the specific compound and 75% by weight of water.
2. Octanoic Acid is thereafter added to the solution in a proportion of 1.6 times the weight of the specific compound in solution, the solution being at a temperature of 20° Celsius. The solution is mixed in a Sotax beaker with a stirrer with a marine propeller, the propeller being situated at about 5 mm above the bottom of the beaker, the mixer being set at a rotation speed of 200 rounds per minute.
3. The specific compound is hydrotrope if the the Octanoic Acid is completely solubilised, i.e. if the solution comprises only one phase, the phase being a liquid phase.

"Non-Aqueous" or "Anhydrous"—As used herein, "non-aqueous" or "anhydrous" are used synonymously and both describe a fluid in which the free water content is less than about 1%.

"Polar Groups"—As used herein, "polar groups" refers to functional groups which have a permanent electric dipole moment that arises from the partial charges on atoms linked by polar bonds. The polar group itself may be anionic or uncharged.

"Dissolution"—As used herein, "dissolution" refers to the rate at which the detergent product mixes with water and releases the active ingredients in the wash.

"Particles"—As used herein, the word "particles" means the entire size range of a detergent final product or component or the entire size range of discrete particles, agglomerates, or granules in a final detergent product or component admixture. It specifically does not refer to a size fraction (i.e., representing less than 100% of the entire size range) of any of these types of particles unless the size fraction represents 100% of a discrete particle in an admixture of particles. For each type of particle component in an admixture, the entire size range of discrete particles of that type have the same or substantially similar composition regardless of whether the particles are in contact with other particles. For agglomerated components, the agglomerates themselves are considered as discrete particles and each discrete particle may be comprised of a composite of smaller primary particles and binder compositions.

"Geometric Mean Particle Diameter"—As used herein, the phrase "geometric mean particle diameter" means the geometric mass median diameter of a set of discrete particles as measured by any standard mass-based particle size measurement technique, preferably by dry sieving.

"Geometric Standard Deviation" or "Span"—As used herein, the phrase "geometric standard deviation" or "span" of a particle size distribution means the geometric breadth of the best-fitted log-normal function to the above-mentioned particle size data which can be accomplished by the ratio of the diameter of the 84.13 percentile divided by the diameter of the $50^{th}$ percentile of the cumulative distribution ($D_{84.13}/D_{50}$); See Gotoh et al, *Powder Technology Handbook*, pp. 6–11, Meral Dekker 1997.

Hydrotropes

The hydrotropes described in this section are an essential component of the present detergent compositions.

It has been discovered in the present invention that the addition of a hydrotrope in which two polar groups are separated from each other by at least 5, preferably 6, aliphatic carbon atoms. Examples of suitable polar groups for inclusion in the hydrotrope include are hydroxyl and carboxyl ions. Particularly preferred hydrotropes are selected from the group consisting of:

1, 4 Cyclo Hexane Di Methanol:

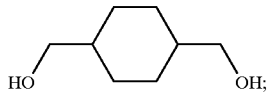

1, 6 Hexandiol:

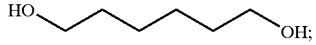

1, 7 Heptanediol:

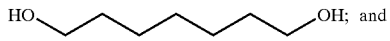

mixtures thereof.

Mixtures of these organic molecules or any number of hydrotropes molecules which consist of two polar groups separated from each other by at least 5, preferably 6, aliphatic carbon atoms are also acceptable. 1,4 Cyclo Hexane Di Methanol may be present in either its cis configuration, its trans configuration or a mixture of both configurations.

A. Liquid Products

The present invention comprises liquid laundry detergent compositions which are either aqueous or non-aqueous and which are suitable for use in an automatic washing machine or for pretreating stains and spots on textile or fabric articles prior to washing. The present liquid laundry detergent compositions may comprise solely a surfactant-rich liquid-phase or they may contain both a surfactant-rich liquid-phase and solid particulate phase which is suspended in the liquid phase. Preferably, the surfactant-rich liquid-phase comprises the hydrotropes, and optionally organic diluents.

The hydrotropes of the present invention, when incorporated into liquid products of the present invention, provide the key ingredient to prevent gelling and/or thickening of the liquid detergent compositions taught herein.

Gelling has been previously observed in the liquid detergent products prepared without the hydrotropes as defined in the present invention, when the products are first contacted and diluted with water. Without being limited by theory, it is believed that this gelling phenomenon results from the surfactant system forming viscous surfactant phases (typically lamellar, spherulitic or hexagonal phases) at certain concentrations of surfactants and water. A correlation has been found between the viscosity of the product: water mixture in the critical dilution range where gelling is observed, and the amount of viscous surfactant phase formed.

In a preferable embodiment, the detergent compositions are non-aqueous, having a surfactant-rich non-aqueous liquid phase and having a solid particulate phase suspended in said liquid phase. In this embodiment, the surfactant-containing, non-aqueous liquid phase will generally comprise from about 49% to 99.95% by weight of the detergent compositions herein. More preferably, this liquid phase is surfactant-structured and will comprise from about 52% to 98.9% by weight of the compositions. Most preferably, this non-aqueous liquid phase will comprise from about 55% to 70% by weight of the compositions herein. Such a surfactant-containing liquid phase will frequently have a density of from about 0.6 to 1.4 g/cc, more preferably from about 0.9 to 1.3 g/cc.

Without being bound by theory, it is believed that the hydrotropes described above prevent the formation of the viscous surfactant phases formed upon dilution, because the hydrotrope can effectively interact with the ordered, structured layers of surfactant molecules, disrupt them and promote the formation of isotropic low-viscosity surfactant phases.

These hydrotropes also provide other benefits for improving the rheology of liquid detergent compositions. For example, it is often difficult to incorporate ethoxylated quaternized amine materials into detergent compositions containing anionic surfactant because the ethoxylated quaternized amine material causes the anionic surfactant to precipitate out of the liquid phase causing the liquid detergent composition to thicken considerably. Nonetheless, it is highly desirable to incorporate these clay soil removal/anti-redeposition agents into a liquid detergent product because they provide important performance benefits. It has been discovered in the present invention that by including the hydrotropes described above the anionic surfactant precipitation and the composition thickening usually observed is avoided and a liquid detergent composition of desirable rheological properties is produced.

Ethoxylated quaternized amine materials are described in greater detail below.

Surfactant-Containing Liquid-Phase

The liquid phase of the liquid detergent compositions herein is preferably formed from hydrotropes, nonionic and anionic surfactants, and one or more organic diluent.

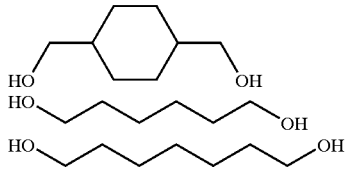

Organic Diluents—The major component of the liquid phase of the detergent compositions herein comprises one or more aqueous or non-aqueous organic diluents. The organic diluents used in this invention may be either surface active liquids, i.e., surfactants, or non-surfactant liquids referred to herein as solvents. The term "solvent" is used herein to connote the non-surfactant liquid portion of the compositions herein. While some of the essential and/or optional components of the compositions herein may actually dissolve in the "solvent"-containing liquid phase, other components will be present as particulate material dispersed within the "solvent"-containing liquid phase. Thus the term "solvent" is not meant to require that the solvent material be capable of actually dissolving all of the detergent composition components added thereto.

The liquid diluent component will generally comprise from about 50% to 90%, more preferably from about 50% to 80%, most preferably from about 55% to 75%, of a structured, surfactant-containing liquid phase. Preferably the liquid phase of the compositions herein, will comprise both liquid surfactants and non-surfactant solvents.

i) Surfactant Liquids—Suitable types of surfactant liquids which can be used to form the liquid phase of the compositions herein include the alkoxylated alcohols, ethylene oxide (EO)-propylene oxide (PO) block polymers, polyhydroxy fatty acid amides, alkylpolysaccharides, and the like. Such normally liquid surfactants are those having an HLB ranging from 10 to 16. Most preferred of the surfactant liquids are the alcohol alkoxylate nonionic surfactants.

Alcohol alkoxylates are materials which correspond to the general formula:

$$R^1(C_mH_{2m}O)_nOH$$

wherein $R^1$ is a $C_8$–$C_{16}$ alkyl group, m is from 2 to 4, and n ranges from about 2 to 12. Preferably $R^1$ is an alkyl group, which may be primary or secondary, that contains from about 9 to 15 carbon atoms, more preferably from about 10 to 14 carbon atoms. Preferably also the alkoxylated fatty alcohols will be ethoxylated materials that contain from about 2 to 12 ethylene oxide moieties per molecule, more preferably from about 3 to 10 ethylene oxide moieties per molecule.

The alkoxylated fatty alcohol materials useful in the liquid phase will frequently have a hydrophilic-lipophilic balance (HLB) which ranges from about 3 to 17. More preferably, the HLB of this material will range from about 6 to 15, most preferably from about 8 to 15.

Examples of fatty alcohol alkoxylates useful in or as the liquid phase of the compositions herein will include those which are made from alcohols of 12 to 15 carbon atoms and which contain about 7 moles of ethylene oxide. Such materials have been commercially marketed under the trade names Neodol 25-7 and Neodol 23-6.5 by Shell Chemical Company. Other useful Neodols include Neodol 1-5, an ethoxylated fatty alcohol averaging 11 carbon atoms in its alkyl chain with about 5 moles of ethylene oxide; Neodol 23-9, an ethoxylated primary $C_{12}$–$C_{13}$ alcohol having about 9 moles of ethylene oxide and Neodol 91-10, an ethoxylated $C_9$–$C_{11}$ primary alcohol having about 10 moles of ethylene oxide. Alcohol ethoxylates of this type have also been marketed by Shell Chemical Company under the Dobanol tradename. Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles of ethylene oxide per mole of fatty alcohol.

Other examples of suitable ethoxylated alcohols include Tergitol 15-S-7 and Tergitol 15-S-9 both of which are linear secondary alcohol ethoxylates that have been commercially marketed by Union Carbide Corporation. The former is a mixed ethoxylation product of $C_{11}$ to $C_{15}$ linear secondary alkanol with 7 moles of ethylene oxide and the latter is a similar product but with 9 moles of ethylene oxide being reacted.

Other types of alcohol ethoxylates useful in the present compositions are higher molecular weight nonionics, such as Neodol 45-11, which are similar ethylene oxide condensation products of higher fatty alcohols, with the higher fatty alcohol being of 14–15 carbon atoms and the number of ethylene oxide groups per mole being about 11. Such products have also been commercially marketed by Shell Chemical Company.

If alcohol alkoxylate nonionic surfactant is utilized as part of the liquid phase in the detergent compositions herein, it will preferably be present to the extent of from about 1% to 60% of the composition structured liquid phase. More preferably, the alcohol alkoxylate component will comprise about 5% to 40% of the structured liquid phase. Most preferably, an alcohol alkoxylate component will comprise from about 5% to 35% of the detergent composition structured liquid phase. Utilization of alcohol alkoxylate in these concentrations in the liquid phase corresponds to an alcohol alkoxylate concentration in the total composition of from about 1% to 60% by weight, more preferably from about 2% to 40% by weight, and most preferably from about 5% to 25% by weight, of the composition.

Another type of surfactant liquid which may be utilized in this invention are the ethylene oxide (EO)— propylene oxide (PO) block polymers. Materials of this type are well known nonionic surfactants which have been marketed under the tradename Pluronic. These materials are formed by adding blocks of ethylene oxide moieties to the ends of polypropylene glycol chains to adjust the surface active properties of the resulting block polymers. EO-PO block polymer nonionics of this type are described in greater detail in Davidsohn and Milwidsky; *Synthetic Detergents 7th Ed.*; Longman Scientific and Technical (1987) at pp. 34–36 and pp. 189–191 and in U.S. Pat. Nos. 2,674,619 and 2,677,700. All of these publications are incorporated herein by reference. These Pluronic type nonionic surfactants are also believed to function as effective suspending agents for the particulate material which is dispersed in the liquid phase of the detergent compositions herein.

Another possible type of surfactant liquid useful in the compositions herein comprises polyhydroxy fatty acid amide surfactants. Materials of this type of nonionic surfactant are those which conform to the formula:

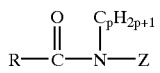

wherein R is a $C_{9-17}$ alkyl or alkenyl, p is from 1 to 6, and Z is glycityl derived from a reduced sugar or alkoxylated derivative thereof. Such materials include the $C_{12}$–$C_{18}$ N-methyl glucamides. Examples are N-methyl N-1-deoxyglucityl cocoamide and N-methyl N-1-deoxyglucityl oleamide. Processes for making polyhydroxy fatty acid, amides are know and can be found, for example, in Wilson, U.S. Pat. No. 2,965,576 and Schwartz, U.S. Pat. No. 2,703,798, the disclosures of which are incorporated herein by reference. The materials themselves and their preparation are also described in greater detail in Honsa, U.S. Pat. No. 5,174,937, Issued Dec. 26, 1992, which patent is also incorporated herein by reference.

The detergent compositions of the present invention may also contain anionic, cationic, and/or amphoteric types. In a preferred embodiment, where the liquid phase is non-aqueous, the liquid phase is prepared by combining the non-aqueous organic liquid diluents described in the present invention with a surfactant which is generally, but not necessarily, selected to add structure to the non-aqueous liquid phase of the detergent compositions herein. Structuring surfactants can be of the anionic, nonionic, cationic, and/or amphoteric types. Thus the surfactants described below may be added for solely their surface-active attributes or for those attributes as well as their structuring ability.

Preferred surfactants are the anionic surfactants such as the alkyl sulfates, the alkyl polyalkxylate sulfates and the linear alkyl benzene sulfonates. Another common type of anionic surfactant material which may be optionally added to the detergent compositions herein as structurant comprises carboxylate-type anionics. Carboxylate-type anionics include the $C_{10}$–$C_{18}$ alkyl alkoxy carboxylates (especially the EO 1 to 5 ethoxycarboxylates) and the $C_{10}$–$C_{18}$ sarcosinates, especially oleoyl sarcosinate. Yet another common type of anionic surfactant material which may be employed as a structurant comprises other sulfonated anionic surfactants such as the $C_8$–$C_{18}$ paraffin sulfonates and the $C_8$–$C_{18}$ olefin sulfonates. Structuring anionic surfactants will generally comprise from about 1% to 30% by weight of the compositions herein.

As indicated, one preferred type of structuring anionic surfactant comprises primary or secondary alkyl sulfate anionic surfactants. Such surfactants are those produced by the sulfation of higher $C_8$–$C_{20}$ fatty alcohols.

Conventional primary alkyl sulfate surfactants have the general formula $$ROSO_3—M^+$$

wherein R is typically a linear $C_8$–$C_{20}$ hydrocarbyl group, which may be straight chain or branched chain, and M is a water-solubilizing cation. Preferably R is a $C_{10-14}$ alkyl, and M is alkali metal. Most preferably R is about $C_{12}$ and M is sodium.

Conventional secondary alkyl sulfates, as described above, may also be utilized as a structuring anionic surfactant for the liquid phase of the compositions herein.

If utilized, alkyl sulfates will generally comprise from about 1% to 30% by weight of the composition, more preferably from about 5% to 25% by weight of the composition. Non-aqueous liquid detergent compositions containing alkyl sulfates, peroxygen bleaching agents, and bleach activators are described in greater detail in Kong-Chan et al.; WO 96/10073; Published Apr. 4, 1996, which application is incorporated herein by reference.

Another preferred type of anionic surfactant material which may be optionally added to the non-aqueous cleaning compositions herein as a structurant comprises the alkyl polyalkoxylate sulfates. Alkyl polyalkoxylate sulfates are also known as alkoxylated alkyl sulfates or alkyl ether sulfates. Such materials are those which correspond to the formula $$R^2—(C_mH_{2m}O)_n—SO_3M$$

wherein $R^2$ is a $C_{10}$–$C_{22}$ alkyl group, m is from 2 to 4, n is from about 1 to 15, and M is a salt-forming cation. Preferably, $R^2$ is a $C_{12}$–$C_{18}$ alkyl, m is 2, n is from about 1 to 10, and M is sodium, potassium, ammonium, alkylammonium or alkanolammonium. Most preferably, $R^2$ is a $C_{12}$–$C_{16}$, m is 2, n is from about 1 to 6, and M is sodium. Ammonium, alkylammonium and alkanolammonium counterions are preferably avoided when used in the compositions herein because of incompatibility with peroxygen bleaching agents.

If utilized, alkyl polyalkoxylate sulfates can also generally comprise from about 1% to 30% by weight of the composition, more preferably from about 5% to 25% by weight of the composition. Non-aqueous liquid detergent compositions containing alkyl polyalkoxylate sulfates, in combination with polyhydroxy fatty acid amides, are described in greater detail in Boutique et al; PCT Application No. PCT/US96/04223, which application is incorporated herein by reference.

The most preferred type of anionic surfactant for use as a structurant in the compositions herein comprises the linear alkyl benzene sulfonate (LAS) surfactants. In particular, such LAS surfactants can be formulated into a specific type of anionic surfactant-containing powder which is especially useful for incorporation into the non-aqueous liquid detergent compositions of the present invention. Such a powder comprises two distinct phases. One of these phases is insoluble in the non-aqueous organic liquid diluents used in the compositions herein; the other phase is soluble in the non-aqueous organic liquids. It is the insoluble phase of this preferred anionic surfactant-containing powder which can be dispersed in the non-aqueous liquid phase of the preferred compositions herein and which forms a network of aggregated small particles that allows the final product to stablely suspend other additional solid particulate materials in the composition.

Further descriptions of suitable surfactants, and methods for preparing such surfactants can be found in the copending application of Jay I. Kahn et al., entitled "Preparation of Nonaqueous, Particulate-containing Liquid Detergent Compositions with Surfactant-Structured Liquid Phase", having P&G Case No. 6150, Ser. No. 09/202,964, filed on Dec. 23, 1998, which is hereby incorporated by reference.

Generally, the liquid surfactant can comprise from about 25% to 70% of the liquid phase of the compositions herein. More preferably, the liquid surfactant will comprise from about 30% to 65% of a structured liquid phase. This corresponds to a liquid surfactant concentration in the total composition of from about 10% to 70% by weight, more preferably from about 20% to 50% by weight, of the composition. The amount of total liquid surfactant in the preferred surfactant-structured, non-aqueous liquid phase herein is as described above and will be further determined by the type and amounts of other composition components and by the desired composition properties.

ii) Non-surfactant Organic Solvents—The liquid phase of the detergent compositions herein may also comprise one or more non-surfactant organic solvents. Such non-surfactant liquids are preferably those of low polarity. For purposes of this invention, "low-polarity" liquids are those which have little, if any, tendency to dissolve one of the preferred types of particulate material used in the compositions herein, i.e., the peroxygen bleaching agents, sodium perborate or sodium percarbonate. Thus relatively polar solvents such as ethanol are preferably not utilized. Suitable types of low-polarity solvents useful in the liquid detergent compositions herein do include alkylene glycol mono lower alkyl ethers, lower molecular weight polyethylene glycols, lower molecular weight methyl esters and amides, and the like.

A preferred type of low-polarity solvent for use in the compositions herein comprises the $C_4$–$C_8$ branched or straight chain alkylene glycols. Materials of this type include hexylene glycol (4-methyl-2,4-pentanediol), 1,3-butylene glycol and 1,4-butylene glycol.

Another preferred type of low-polarity solvent for use herein comprises the mono-, di-, tri-, or tetra-$C_2$–$C_3$ alkylene glycol mono $C_2$–$C_6$ alkyl ethers. The specific examples of such compounds include diethylene glycol monobutyl ether, tetraethylene glycol monobutyl ether, dipropolyene glycol monoethyl ether, and dipropylene glycol monobutyl ether. Diethylene glycol monobutyl ether, dipropylene glycol monobutyl ether and butoxy-propoxy-propanol (BPP) are especially preferred. Compounds of the type have been commercially marketed under the tradenames Dowanol, Carbitol, and Cellosolve.

Another preferred type of low-polarity organic solvent useful herein comprises the lower molecular weight polyethylene glycols (PEGs). Such materials are those having molecular weights of at least about 150. PEGs of molecular weight ranging from about 200 to 600 are most preferred.

Yet another preferred type of non-polar solvent comprises lower molecular weight methyl esters. Such materials are those of the general formula: $R^1$—C(O)—$OCH_3$ wherein $R^1$ ranges from 1 to about 18. Examples of suitable lower molecular weight methyl esters include methyl acetate, methyl propionate, methyl octanoate, and methyl dodecanoate.

The generally low-polarity, non-surfactant organic solvent (s) employed should, of course, be compatible and non-reactive with other composition components, e.g., bleach and/or activators, used in the liquid detergent compositions herein. Such a solvent component is preferably utilized in an amount of from about 1% to 70% by weight of the liquid phase. More preferably, a low-polarity, non-surfactant solvent will comprise from about 10% to 60% by weight of a structured liquid phase, most preferably from about 20% to 50% by weight, of a structured liquid phase of the composition. Utilization of non-surfactant solvent in these concentrations in the liquid phase corresponds to a non-surfactant solvent concentration in the total composition of from about 1% to 50% by weight, more preferably from about 5% to 40% by weight, and most preferably from about 10% to 30% by weight, of the composition.

iii) Blends of Surfactant and Non-surfactant Solvents—In the preferred embodiments which employ both non-aqueous surfactant liquids and non-aqueous non-surfactant solvents, the ratio of surfactant to non-surfactant liquids, e.g., the ratio of alcohol alkoxylate to low polarity solvent, within a structured, surfactant-containing liquid phase can be used to vary the rheological properties of the detergent compositions eventually formed. Generally, the weight ratio of surfactant liquid to non-surfactant organic solvent will range about 50:1 to 1:50. More preferably, this ratio will range from about 3:1 to 1:3, most preferably from about 2:1 to 1:2.

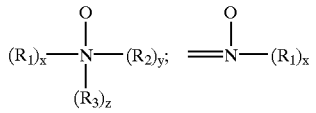

Solid Particulate Materials

In addition to the surfactant-containing liquid phase, the liquid detergent compositions herein also preferably comprise from about 1% to 50% by weight, more preferably from about 29% to 44% by weight, of additional solid phase particulate material which is dispersed and suspended within the liquid phase. Generally such particulate material will range in size from about 0.1 to 1500 microns, more preferably from about 0.1 to 900 microns. Most preferably, such material will range in size from about 5 to 200 microns.

The additional particulate material utilized herein can comprise one or more types of detergent composition components which in particulate form are substantially insoluble in the liquid phase of the composition. Such materials include peroxygen bleaching agents, bleach activators, organic detergent builders, inorganic alkalinity sources and combinations thereof. The types of particulate materials which can be utilized are described in detail, below, as follows, however, some materials can either be included in the particulate component or in the surfactant-containing liquid phase.

In a preferred embodiment the particulate material comprises the dye transfer inhibitor PVNO (see above for detailed description), an aluminosilicate detergent builder as well as other particulate minor components.

(a) Bleaching Agent With Optional Bleach Activators—The most preferred type of particulate material useful in the detergent compositions herein comprises particles of a peroxygen bleaching agent. Such peroxygen bleaching agents may be organic or inorganic in nature. Inorganic peroxygen bleaching agents are frequently utilized in combination with a bleach activator.

Useful organic peroxygen bleaching agents include percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, Issued Nov. 20, 1984; European Patent Application EP-A-133,354, Banks et al., Published Feb. 20, 1985; and U.S. Pat. No. 4,412,934, Chung et al., Issued Nov. 1, 1983. Highly preferred bleaching agents also include 6-nonylamino-6-oxoperoxycaproic acid (NAPAA) as described in U.S. Pat. No. 4,634,551, Issued Jan. 6, 1987 to Burns et al.

Inorganic peroxygen bleaching agents may also be used in particulate form in the detergent compositions herein. Inorganic bleaching agents are in fact preferred. Such inorganic peroxygen compounds include alkali metal perborate and percarbonate materials, most preferably the percarbonates. For example, sodium perborate (e.g. mono- or tetra-hydrate) can be used. Suitable inorganic bleaching agents can also include sodium or potassium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used. Frequently inorganic peroxygen bleaches will be coated with silicate, borate, sulfate or water-soluble surfactants. For example, coated percarbonate particles are available from various commercial sources such as FMC, Solvay Interox, Tokai Denka and Degussa.

Inorganic peroxygen bleaching agents, e.g., the perborates, the percarbonates, etc., are preferably combined with bleach activators, which lead to the in situ production in aqueous solution (i.e., during use of the compositions herein for fabric laundering/bleaching) of the peroxy acid corresponding to the bleach activator. Various non-limiting examples of activators are disclosed in U.S. Pat. No. 4,915,854, Issued Apr. 10, 1990 to Mao et al.; and U.S. Pat. No. 4,412,934 Issued Nov. 1, 1983 to Chung et al. The nonanoyloxybenzene sulfonate (NOBS) and tetraacetyl ethylene diamine (TAED) activators are typical. Mixtures thereof can also be used. See also the hereinbefore referenced U.S. Pat. No. 4,634,551 for other typical bleaches and activators useful herein.

Other useful amido-derived bleach activators are described in U.S. Pat. No. 5,891,838, issued Apr. 6, 1999 to Angell et al., and the copending provisional application of Diane Parry entitled "Non-aqueous, Liquid Detergent Compositions Containing Gasified Particulate Matter," P&G Case No. 7173P, Ser. No. 60/088,170 filed Jun. 5, 1998, both of which is hereby incorporated by reference.

If peroxygen bleaching agents are used as all or part of the additional particulate material, they will generally comprise from about 1% to 30% by weight of the composition. More preferably, peroxygen bleaching agent will comprise from about 1% to 20% by weight of the composition. Most preferably, peroxygen bleaching agent will be present to the extent of from about 5% to 20% by weight of the composition. If utilized, bleach activators can comprise from about 0.5% to 20%, more preferably from about 3% to 10%, by weight of the composition. Frequently, activators are employed such that the molar ratio of bleaching agent to activator ranges from about 1:1 to 10:1, more preferably from about 1.5:1 to 5:1.

(b) Transition Metal Bleach Catalysts—Another possible type of additional particulate material which can be suspended in the liquid detergent compositions herein comprises transition metal bleach catalysts which encourage the catalytic oxidation of soils and stains on fabric surfaces. Such compounds are present in a catalytically effective amount, preferably from about 1 ppb to about 99.9%, more typically from about 0.001 ppm to about 49%, preferably from about 0.05 ppm to about 500 ppm (wherein "ppb" denotes parts per billion by weight and "ppm" denotes parts per million by weight), of a laundry detergent composition. The transition-metal bleach catalyst comprises a complex of a transition metal selected from the group consisting of Mn(II), Mn(III), Mn(IV), Mn(V), Fe(II), Fe(III), Fe(IV), Co(I), Co(II), Co(III), Ni(I), Ni(II), Ni(III), Cu(I), Cu(II), Cu(III), Cr(II), Cr(III), Cr(IV), Cr(V), Cr(VI), V(III), V(IV), V(V), Mo(IV), Mo(V), Mo(VI), W(IV), W(V), W(VI), Pd(II), Ru(II), Ru(III), and Ru(IV) coordinated with a macropolycyclic rigid ligand, preferably a cross-bridged macropolycyclic ligand, having at least 4 donor atoms, at least two of which are bridgehead donor atoms. These catalysts are discussed with greater specificity in the copending provisional application of Daryle H. Busch et al., entitled "Catalysts and Methods for Catalytic Oxidation", having P&G Case No. 6524P, Ser. No. 60/040,629, which is hereby incorporated by reference.

(c) Organic Builder Material—Another possible type of additional particulate material which can be suspended in the liquid detergent compositions herein comprises an organic detergent builder material which serves to counteract the effects of calcium, or other ion, water hardness encountered during laundering/bleaching use of the compositions herein. Examples of such materials include the alkali metal, citrates, succinates, malonates, fatty acids, carboxymethyl succinates, carboxylates, polycarboxylates and polyacetyl carboxylates. Specific examples include sodium, potassium and lithium salts of oxydisuccinic acid, mellitic acid, benzene polycarboxylic acids and citric acid. Other examples of organic phosphonate type sequestering agents such as those which have been sold by Monsanto under the Dequest tradename and alkanehydroxy phosphonates. Citrate salts are highly preferred.

Other suitable organic builders include the higher molecular weight polymers and copolymers known to have builder properties. For example, such materials include appropriate polyacrylic acid, polymaleic acid, and polyacrylic/polymaleic acid copolymers and their salts, such as those sold by BASF under the Sokalan trademark which have molecular weight ranging from about 5,000 to 100,000.

Another suitable type of organic builder comprises the water-soluble salts of higher fatty acids, i.e., "soaps". These include alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

If utilized as all or part of the additional particulate material, insoluble organic detergent builders can generally comprise from about 2% to 20% by weight of the compositions herein. More preferably, such builder material can comprise from about 4% to 10% by weight of the composition.

(d) Inorganic Alkalinity Sources—Another possible type of additional particulate material which can be suspended in the liquid detergent compositions herein can comprise a material which serves to render aqueous washing solutions formed from such compositions generally alkaline in nature. Such materials may or may not also act as detergent builders, i.e., as materials which counteract the adverse effect of water hardness on detergency performance.

Examples of suitable alkalinity sources include water-soluble alkali metal carbonates, bicarbonates, borates, silicates and metasilicates. Although not preferred for ecological reasons, water-soluble phosphate salts may also be utilized as alkalinity sources. These include alkali metal pyrophosphates, orthophosphates, polyphosphates and phosphonates. Of all of these alkalinity sources, alkali metal carbonates such as sodium carbonate are the most preferred.

The alkalinity source, if in the form of a hydratable salt, may also serve as a desiccant in the liquid detergent compositions herein. The presence of an alkalinity source which is also a desiccant may provide benefits in terms of chemically stabilizing those composition components such as the peroxygen bleaching agent which may be susceptible to deactivation by water.

If utilized as all or part of the additional particulate material component, the alkalinity source will generally comprise from about 1% to 25% by weight of the compositions herein. More preferably, the alkalinity source can comprise from about 2% to 15% by weight of the composition. Such materials, while water-soluble, will generally be insoluble in the non-aqueous detergent compositions described herein.

As indicated hereinafter, the aqueous and non-aqueous liquid detergent compositions herein may be in the form of bleaching agent and/or other materials in particulate form as a solid phase suspended in and dispersed throughout a surfactant-containing, preferably structured, preferably non-aqueous liquid phase. Generally, the structured non-aqueous liquid phase will comprise from about 49% to 99.95%, more preferably from about 52% to 98.5%, by weight of the composition with the dispersed additional solid materials comprising from about 1% to 50%, more preferably from about 29% to 44%, by weight of the composition.

Very small amounts of water may be incorporated into the particulate-containing non-aqueous embodiments of the present liquid detergent composition. However, in such embodiments, the amount of free water should in no event exceed about 1% by weight of the compositions herein. More preferably, the water content of the non-aqueous detergent compositions herein will comprise less than about 1% by weight.

As disclosed herein, the compositions of this invention can also be used to form aqueous laundry detergent compositions. Additional components suitable for use in an aqueous liquid laundry detergent composition can be found in U.S. Pat. No. 5,783,548, to Fredj et al. and U.S. Pat. No. 5,648,327, to Smerznak et al.

The particulate-containing non-aqueous liquid detergent compositions herein will be relatively viscous and phase stable under conditions of commercial marketing and use of such compositions. Frequently the viscosity of the compositions herein will range from about 300 to 8,000 cps, more preferably from about 1000 to 4,000 cps. For purposes of this invention, viscosity is measured with a Carrimed CSL2 Rheometer at a shear rate of 20 $s^{-1}$.

The preparation of non-aqueous liquid detergent compositions is discussed in detail in Copending application of Jay I. Kahn et al., entitled "Preparation of Nonaqueous, Particulate-Containing Liquid Detergent Compositions with Surfactant-Structured Liquid Phase", having P&G Case No. 6150, Ser. No. 09/202,964, filed on Dec. 23, 1998, now U.S. Pat. No. 6,277,804 which is hereby incorporated by reference.

An effective amount of the liquid detergent compositions herein added to water to form aqueous laundering/bleaching solutions can comprise amounts sufficient to form from about 500 to 10,000 ppm of composition in aqueous solution. More preferably, from about 800 to 8,000 ppm of the detergent compositions herein will be provided in aqueous washing/bleaching solution.

B. Granular/Powder Products

The granular/powder detergent products of the present invention comprise in addition to one or more of the hydrotropes, preferably one or more preferred ingredients hereinbelow and optionally, one or more conventional detergent adjunct materials. Such conventional adjunct materials can include one or more of the solid particulate materials described under the Liquid Products section hereinabove or under the Conventional Detergent Adjunct Materials section hereinafter.

While the use of hydrotropes is to provide desirable phase formation and product viscosity is well-known, the use of these organic molecules as hydrotropes to prevent gelling and/or thickening of the detergent compositions taught herein and thus improve the dissolution and dispersion performance of a granular detergent product has not been previously disclosed. Gelling has been previously observed in detergent products prepared without the hydrotropes as defined in the present invention, when the products are first contacted and diluted with water.

Without being limited by theory, it is believed that this gelling phenomenon results from the surfactant-containing particles forming either viscous surfactant phases (typically lamellar, spherulitic or hexagonal phases) or inner-connected "lump-gels" the upon contact with water in the wash-liquor or wash-water at certain concentrations of surfactant. A correlation has been found between the viscosity of the product-water mixture in the critical dilution range where gelling is observed, and the amount of viscous surfactant phase formed in this range.

The problem is particularly pronounced in those areas in which fabric laundering in automatic clothes washer occurs in relatively cold wash water or under mild agitation (such as in Japan). The typical surfactant-water phase diagram shows regions of stability for high-viscosity neat or gel surfactant phases at the relatively cold wash-water temperatures. And under conditions of mild agitation, there is insufficient mechanical energy imparted by the agitator to disrupt the formation of these high-viscosity phases.

The granular detergent compositions taught herein can be either in the form of a single particle or may be in the form of multiple particles each with its own composition. In the case where the detergent is composed of multiple detergent particles, it is preferred that the organic hydrotrope disclosed above be contained in or coat the surface of those particles which are surfactant rich.

Preferred Ingredients

Detersive Surfactants—The anionic surfactants useful in the present invention are split into the alkyl sulfate surfactants which according to the present invention are separated from the electrolytes in the detergent composition and the remaining anionic surfactants which may be formulated in either particle. For the purposes of the present invention, the alkyl sulfates are defined as alkyl sulfates, alkyl alkoxy sulfate, alkyl sulfonates, alkyl alkoxy carboxylate, alkyl alkoxylated sulfates with the remaining anionic surfactant being selected from the group consisting of alkylbenzene sulfonate, alpha olefin sulfonate, paraffin sulfonates, alkyl ester sulfonates, sarcosinates, taurinates, and mixtures thereof.

When present, anionic surfactant will be present typically in an effective amount in the overall detergent composition. More preferably, the composition may contain at least about 0.5%, more preferably at least about 5%, even more preferably still, at least about 10% by weight of said composition of anionic surfactant. The composition will also preferably contain no more than about 90%, more preferably no more than about 50%, even more preferably, no more than about 30% by weight of said composition of anionic surfactant.

Alkyl sulfate surfactants providing excellent overall cleaning ability alone and particularly when used in combination with polyhydroxy fatty acid amides (see below), including good grease/oil cleaning over a wide range of temperatures, wash concentrations, and wash times, dissolution of alkyl sulfates can be obtained, as well as improved formulability in liquid detergent formulations are water soluble salts or acids of the formula ROSO3M wherein R preferably is a C10–C24 hydrocarbyl, preferably an alkyl or hydroxyalkyl having a C10–C20 alkyl component, more preferably a C12–C18 alkyl or hydroxyalkyl, and M is H or a cation, e.g., an alkali (Group IA) metal cation (e.g., sodium, potassium, lithium), substituted or unsubstituted ammonium cations such as methyl-, dimethyl-, and trimethyl ammonium and quaternary ammonium cations, e.g., tetramethyl-ammonium and dimethyl piperdinium, and cations derived from alkanolamines such as ethanolamine, diethanolamine, triethanolamine, and mixtures thereof, and the like. Typically, alkyl chains of C12–16 are preferred for lower wash temperatures (e.g., below about 50° C.) and C16–18 alkyl chains are preferred for higher wash temperatures (e.g., above about 50° C.).

Another suitable type of alkyl sulfate surfactant according to the present invention are the secondary (2,3) alkyl sulfates. These surfactants preferably are of the formula:

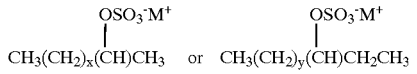

wherein x and (y+1) are integers of at least about 7, preferably at least about 9. Preferably these surfactants contain from 10 to 18 carbon atoms. Suitable examples of these anionic surfactants are disclosed in U.S. Pat. No. 3,234,258 Morris, issued Feb. 8, 1966; U.S. Pat. No. 5,075,041 Lutz, issued Dec. 24, 1991; U.S. Pat. No. 5,349,101 Lutz et al., issued Sep. 20, 1994; and U.S. Pat. No. 5,389,277 Prieto, issued Feb. 14, 1995 each incorporated herein by reference.

Another suitable type of alkyl sulfate surfactant according to the present invention are the alkyl alkoxylated sulfate. These surfactants are water soluble salts or acids typically of the formula RO(A)mSO3M wherein R is an unsubstituted C10–C24 alkyl or hydroxyalkyl group having a C10–C24 alkyl component, preferably a C12–C20 alkyl or hydroxyalkyl, more preferably C12–C18 alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium and quaternary ammonium cations, such as tetramethyl-ammonium, dimethyl piperidinium and cations derived from alkanolamines, e.g. monoethanolamine, diethanolamine, and triethanolamine, and mixtures thereof. Exemplary surfactants are C12–C18 alkyl polyethoxylate (1.0) sulfate, C12–C18 alkyl polyethoxylate (2.25) sulfate, C12–C18 alkyl polyethoxylate (3.0) sulfate, and C12–C18 alkyl polyethoxylate (4.0) sulfate wherein M is conveniently selected from sodium and potassium. Surfactants for use herein can be made from natural or synthetic alcohol feedstocks. Chain lengths represent average hydrocarbon distributions, including branching. The anionic surfactant component may comprise alkyl sulfates and alkyl ether sulfates derived from conventional alcohol sources, e.g., natural alcohols, synthetic alcohols such as those sold under the trade name of NEODOL™, ALFOL™, LIALL™, LUTENSOL™ and the like. Alkyl ether sulfates are also known as alkyl polyethoxylate sulfates.

Another type of alkyl sulfate surfactant according to the present invention are one or more (preferably a mixture of two or more) mid-chain branched surfactants, preferably mid-chain branched alkyl alkoxy alcohols having the formula:

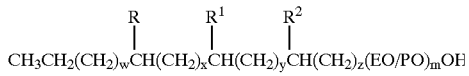

mid-chain branched alkyl sulfates having the formula:

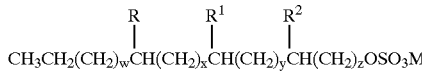

and mid-chain branched alkyl alkoxy sulfates having the formula:

$$CH_3CH_2(CH_2)_wCH(R)(CH_2)_xCH(R^1)(CH_2)_yCH(R^2)(CH_2)_z(EO/PO)_mOSO_3M$$

wherein the total number of carbon atoms in the branched primary alkyl moiety of these formulae (including the R, $R^1$, and $R^2$ branching, but not including the carbon atoms which comprise any EO/PO alkoxy moiety) is from 14 to 20, and wherein further for this surfactant mixture the average total number of carbon atoms in the branched primary alkyl moieties having the above formula is within the range of greater than 14.5 to about 17.5 (preferably from about 15 to about 17); R, $R^1$, and $R^2$ are each independently selected from hydrogen, $C_1$–$C_3$ alkyl, and mixtures thereof, preferably methyl; provided R, $R^1$, and $R^2$ are not all hydrogen and, when z is 1, at least R or $R^1$ is not hydrogen. M is a water soluble cation and may comprises more than one type of cation, for example, a mixture of sodium and potassium. The index w is an integer from 0 to 13; x is an integer from 0 to 13; y is an integer from 0 to 13; z is an integer of at least 1; provided w+x+y+z is from 8 to 14. EO and PO represent ethylencoxy units and propyleneoxy units having the formula:

$$-CH(CH_3)CH_2O- \quad \text{or} \quad -CH_2CH(CH_3)O-$$

respectively, however, other alkoxy units inter alia 1,3-propyleneoxy, butoxy, and mixtures thereof are suitable as alkoxy units appended to the mid-chain branched alkyl moieties.

The mid-chain branched surfactants are preferably mixtures which comprise a surfactant system. Therefore, when the surfactant system comprises an alkoxylated surfactant, the index m indicates the average degree of alkoxylation within the mixture of surfactants. As such, the index m is at least about 0.01, preferably within the range of from about 0.1, more preferably from about 0.5, most preferably from about 1 to about 30, preferably to about 10, more preferably to about 5. When considering a mid-chain branched surfactant system which comprises only alkoxylated surfactants, the value of the index m represents a distribution of the average degree of alkoxylation corresponding to m, or it may be a single specific chain with alkoxylation (e.g., ethoxylation and/or propoxylation) of exactly the number of units corresponding to m.

The preferred mid-chain branched surfactants of the present invention which are suitable for use in the surfactant systems of the present invention have the formula:

$$CH_3(CH_2)_aCH(CH_3)(CH_2)_bCH_2(EO/PO)_mOSO_3M$$

or the formula:

$$CH_3(CH_2)_dCH(CH_3)(CH_2)_eCH(CH_3)CH_2(EO/PO)_mOSO_3M$$

wherein a, b, d, and e are integers such that a+b is from 10 to 16 and d+e is from 8 to 14; M is selected from sodium, potassium, magnesium, ammonium and substituted ammonium, and mixtures thereof.

The surfactant systems of the present invention which comprise mid-chain branched surfactants are preferably formulated in two embodiments. A first preferred embodiment comprises mid-chain branched surfactants which are formed from a feedstock which comprises 25% or less of mid-chain branched alkyl units. Therefore, prior to admixture with any other conventional surfactants, the mid-chain branched surfactant component will comprise 25% or less of surfactant molecules which are non-linear surfactants.

A second preferred embodiment comprises mid-chain branched surfactants which are formed from a feedstock which comprises from about 25% to about 70% of mid-chain branched alkyl units. Therefore, prior to admixture with any other conventional surfactants, the mid-chain branched surfactant component will comprise from about 25% to about 70% surfactant molecules which are non-linear surfactants.

These surfactants are further described in U.S. Patent Application No. 60/061,971, Oct. 14, 1997, No. 60/061,975, Oct. 14, 1997, No. 60/062,086, Oct. 14, 1997, No. 60/061,916, Oct. 14, 1997, No. 60/061,970, Oct. 14, 1997, No. 60/062,407, Oct. 14, 1997. Other suitable mid-chain branched surfactants can be found in U.S. Patent application Ser. Nos. 60/032,035, 60/031,845, 60/031,916, 60/031,917, 60/031,761, 60/031,762, and 60/031,844. Mixtures of these branched surfactants with conventional linear surfactants are also suitable for use in the present compositions.

Of the anionic surfactants according to the present invention which are not included in the alkyl sulfates according to the present invention one type of anionic surfactant which can be utilized encompasses alkyl ester sulfonates. These are desirable because they can be made with renewable, non-petroleum resources. Preparation of the alkyl ester sulfonate surfactant component can be effected according to known methods disclosed in the technical literature. For instance, linear esters of C8–C20 carboxylic acids can be sulfonated with gaseous SO3 according to "The Journal of the American Oil Chemists Society," 52 (1975), pp. 323–329. Suitable starting materials would include natural fatty substances as derived from tallow, palm, and coconut oils, etc.

The preferred alkyl ester sulfonate surfactant, especially for laundry applications, comprises alkyl ester sulfonate surfactants of the structural formula:

$$R^3CH(SO_3M)C(=O)OR^4$$

wherein R3 is a C8–C20 hydrocarbyl, preferably an alkyl, or combination thereof, R4 is a C1–C6 hydrocarbyl, preferably an alkyl, or combination thereof, and M is a soluble salt-forming cation. Suitable salts include metal salts such as sodium, potassium, and lithium salts, and substituted or unsubstituted ammonium salts, such as methyl-, dimethyl, -trimethyl, and quaternary ammonium cations, e.g. tetramethyl-ammonium and dimethyl piperdinium, and cations derived from alkanolamines, e.g. monoethanol-amine, diethanolamine, and triethanolamine. Preferably, R3 is C10–C16 alkyl, and R4 is methyl, ethyl or isopropyl. Especially preferred are the methyl ester sulfonates wherein R3 is C14–C16 alkyl.

Another type of anionic surfactant which can be utilized encompasses alkylbenzenesulphonates. These include the hard (ABS, TPBS), linear types, also known as LAS, and made by known process such as various HF or solid HF e.g., DETAL® (UOP) process, or made by using other Lewis Acid catalysts e.g., $AlCl_3$, or made using acidic silica/alumina or made from chlorinated hydrocarbons, such as $C_9$–$C_{20}$ linear alkylbenzene sulfonates, particularly sodium linear alkyl $C_{10}$–$C_{15}$ benzene sulfonate. These surfactants are water soluble salts or acids typically of the formula RASO3M wherein R is a branched or linear C10–C24 alkyl group, preferably a C10–C20 alkyl, more preferably C10-C18 alkyl, A is an aryl group, preferably benzene, or toluene, more preferably benzene unit, and M is H or a cation which can be, for example, a metal cation (e.g., sodium, potassium, lithium, etc.), ammonium or substituted-ammonium cation.

The surfactant systems of the laundry detergent compositions of the present invention can also comprise from about 0.001%, preferably from about 1%, more preferably from about 5%, most preferably from about 10% to about 100%, preferably to about 60%, more preferably to about 30% by weight, of the surfactant system, of one or more (preferably a mixture of two or more) modified alkyl arylsulfonate surfactants, or MLAS preferably surfactants wherein the aryl unit is a benzene ring having the formula:

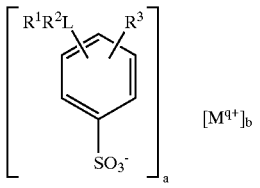

wherein L is an acyclic hydrocarbyl moiety comprising from 6 to 18 carbon atoms; $R^1$, $R^2$, and $R^3$ are each independently hydrogen or $C_{1-3}$ alkyl, provided $R^1$ and $R^2$ are not attached at the terminus of the L unit; M is a water soluble cation having charge q wherein a and b are taken together to satisfy charge neutrality.

These and other suitable MLAS surfactants are further described in copending U.S. Patent Applications No. 60/053,319 filed on Jul. 21, 1997, No. 60/053,318, filed on Jul. 21, 1997, No. 60/053,321, filed on Jul. 21, 1997, No. 60/053,209, filed on Jul. 21, 1997, No. 60/053,328, filed on Jul. 21, 1997, No. 60/053,186, filed on Jul. 21, 1997, No. 60/105,017 filed on Oct. 20, 1998, No. 60/104,962 filed on Oct. 20, 1998, and No. 60/144,519 filed on Jul. 19, 1999. Mixtures of these modified surfactants with conventional surfactants and/or branched surfactants, such as those described herein, are also suitable for use in the present compositions.

Examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Other anionic surfactants useful for detersive purposes can also be included in the compositions hereof. These can include salts (including, for example, sodium, potassium, ammonium, and substituted ammonium salts such as mono-, di- and triethanolamine salts) of soap, C8–C22 primary or secondary alkanesulphonates, C8–C24 olefinsulphonates, sulphonated polycarboxylic acids prepared by sulphonation of the pyrolyzed product of alkaline earth metal citrates, e.g., as described in British patent specification No. 1,082,179, alkyl glycerol sulfonates, fatty acyl glycerol sulfonates, fatty oleyl glycerol sulfates, alkyl phenol ethylene oxide ether sulfates, paraffin sulfonates, alkyl phosphates, isothionates such as the acyl isothionates, N-acyl taurates, fatty acid amides of methyl tauride, alkyl succinamates and sulfosuccinates, monoesters of sulfosuccinate (especially saturated and unsaturated C12–C18 monoesters) diesters of sulfosuccinate (especially saturated and unsaturated C6–C14 diesters), N-acyl sarcosinates, sulfates of alkylpolysaccharides such as the sulfates of alkylpolyglucoside (the nonionic nonsulfated compounds being described below), branched primary alkyl sulfates, alkyl polyethoxy carboxylates such as those of the formula RO(CH2CH2O)kCH2COO—M+wherein R is a C8–C22 alkyl, k is an integer from 0 to 10, and M is a soluble salt-forming cation, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Another type of useful anionic surfactant are the so-called dianionics. These are surfactants which have at least two anionic groups present on the surfactant molecule. Some suitable dianionic surfactants are further described in copending U.S. Ser. Nos. 60/020,503, 60/020,772, 60/020,928, 60/020,832 and 60/020,773 all filed on Jun. 28, 1996, and 60/023,539, 60/023,493, 60/023,540 and 60/023,527 filed on Aug. 8, 1996, the disclosures of which are incorporated herein by reference.

C. Tablet Products

The tablet detergent products of the present invention comprise in addition to one or more of the hydrotropes ("binding agents" because they have a cohesive effect on the tablets), preferably one or more preferred ingredients hereinbelow and optionally, one or more conventional detergent adjunct materials. Such conventional adjunct materials can include one or more of the solid particulate materials described under the Liquid Products section and/or Granular/Powder Products section hereinabove or under the Conventional Detergent Adjunct Materials section hereinafter.

Detergent tablet formulations generally contain at least a small amount of binding agent in the composition in order to provide a cohesive effect and promote the integrity of the tablets. For the purpose of this invention, the Cohesive Effect on the particulate material of a detergent matrix is characterised by the force required to break a tablet based on the examined detergent matrix pressed under controlled compression conditions. Means to assess tablet strength (also refer to diametrical fracture stress) are given in Pharmaceutical dosage forms: tablets volume 1 Ed. H. A. Lieberman et al, published in 1989.

It has been found that the addition of these hydrotrope compounds to a particulate material prepared according to the present invention has a cohesive effect while also providing excellent disintegration performance in wash-water when it is formed into a tablet by compressing the particulate material. Detergent tablets containing this hydrotrope have a higher tensile strength at constant compacting force or an equal tensile strength at lower compacting force when compared to traditional tablets.

In addition to the cohesive effect that they provide, these hydrotropes also provide the key ingredient to prevent gelling and/or thickening of the detergent compositions taught herein. Gelling has been previously observed in detergent products prepared without the hydrotropes as defined in the present invention, when the products are first contacted and diluted with water. Without being limited by theory, it is believed that this gelling phenomenon results from the surfactant-containing particles forming viscous surfactant phases (typically lamellar, spherulitic or hexagonal phases) upon contact with water in the wash-liquor or wash-water at certain concentrations of surfactant. A correlation has been found between the viscosity of the product-water mixture in the critical dilution range where gelling is observed, and the amount of viscous surfactant phase formed in this range.

Without being bound by theory, it is believed that the hydrotropes described above prevent the formation of the viscous surfactant phases formed upon dilution, because the hydrotrope can effectively interact with the ordered, structured layers of surfactant molecules, disrupt them and promote the formation of isotropic low-viscosity surfactant phases.

In the present invention, there is also an additional benefit that the inclusion of these special hydrotropes expands the "operating window" of the detergent tablets. The operating window relates to the range in the bulk density of the detergent tablets, when the detergent tablets are manufactured on an industrial scale. Because of several variables, during the industrial-scale manufacture of detergent tablets the density of the detergent tablets varies somewhat from the ideal or preferred density. The operating window is the range of densities surrounding the preferred density where the tablet is not at the preferred density but is still acceptable. Below the operating window, the density is too low as a result of insufficient packing and cohesion during the compression step and thus the tablet is very friable and likely to be broken during handling and storage. Above the operating window, the tablet is packed too tightly and is likely to be insufficiently dissolved and dispersed in a wash liquor during a wash process.

In addition to these hydrotropes discussed above, the present detergent tablets may also include additional non-gelling binders. Non-gelling binders not only provide cohesive benefits, but also facilitate dissolution.

If non gelling binders are used, suitable non-gelling binders include synthetic organic polymers such as polyethylene glycols, polyvinylpyrrolidones, polyacrylates and water-soluble acrylate copolymers. The handbook of Pharmaceutical Excipients second edition, has the following binders classification: *Acacia*, Alginic Acid, Carbomer, Carboxymethylcellulose sodium, Dextrin, Ethylcellulose, Gelatin, Guar gum, Hydrogenated vegetable oil type I, Hydroxyethyl cellulose, Hydroxypropyl methylcellulose, Liquid glucose, Magnesium aluminum silicate, Maltodextrin, Methylcellulose, polymethacrylates, povidone, sodium alginate, starch and zein. Most preferable binders also have an active cleaning function in the laundry wash such as cationic polymers, i.e. ethoxylated hexamethylene diamine quaternary compounds, bishexamethylene triamines, or others such as pentaamines, ethoxylated polyethylene amines, maleic acrylic polymers.

Non-gelling binder materials are preferably sprayed on and hence have an appropriate melting point temperature below 90° C., preferably below 70° C. and even more preferably below 50° C. so as not to damage or degrade the other active ingredients in the matrix. Most preferred are non-aqueous liquid binders (i.e. not in aqueous solution) which may be sprayed in molten form. However, they may also be solid binders incorporated into the matrix by dry addition but which have binding properties within the tablet.

The detergent tablets prepared according to the present invention will comprise from about 0.05% to about 5%, preferably from about 0.1% to about 3%, most preferably from about 0.1% to about 1% of the essential hydrotrope in which two polar groups are separated from each other by at least 5, preferably 6, aliphatic carbon atoms. When the optional non-gelling binder materials are used, they will be present in the detergent tablets, they will be used in levels of from about 0.1% to about 7%, pref. from about 0.5% to about 5%, more pref. from about 1% to about 3% of the detergent tablet. When the optional non-gelling binders are used they will be present in the detergent tablets in a ratio of non-gelling binder to special hydrotrope binder of from about 2:1 to about 60:1, preferably from about 3:1 to about 30:1, more preferably from about 3:1 to about 15:1.

Disintegrants—Although it is necessary that the tablets should have good integrity before use, it is necessary also that they should disintegrate rapidly during use, when contacted with wash-water. Thus it is also known to include a disintegrant which will promote disintegration of the tablet. Various classes of disintegrant are known, including the class in which disintegration is caused by swelling of the disintegrant. Various swelling disintegrants have been proposed in the literature, with the preference being directed predominantly towards starches, celluloses and water soluble organic polymers. Inorganic swelling disintegrants such as bentonite clay have also been mentioned, for instance in EP-A-466,484.

Some materials acts as binder and disintegrant. It is also mentioned therein that the disintegrant may give supplementary building, anti-redeposition or fabric softening properties. The amount of disintegrant is preferably 1 to 5%. It is proposed in EP-A-466,484 that the tablet may have a heterogeneous structure comprising a plurality of discrete regions, for example layers, inserts or coatings.

Tablet Manufacture—Detergent tablets of the present invention can be prepared simply by mixing the solid ingredients together and compressing the mixture in a conventional tablet press as used, for example, in the pharmaceutical industry. Preferably the principal ingredients, in particular gelling surfactants, are used in particulate form. Any liquid ingredients, for example surfactant or suds suppressor, can be incorporated in a conventional manner into the solid particulate ingredients.

The ingredients such as builder and surfactant can be spray-dried in a conventional manner and then compacted at a suitable pressure. Preferably, the tablets according to the invention are compressed using a force of less than 100000N, more preferably of less than 50000N, even more preferably of less than 5000N and most preferably of less than 3000 N. Indeed, the most preferred embodiment is a tablet compressed using a force of less than 2500N.

The particulate material used for making the tablet of this invention can be made by any particulation or granulation process. An example of such a process is spray drying (in a co-current or counter current spray drying tower) which typically gives low bulk densities 600 g/l or lower. Particulate materials of higher density can be prepared by granulation and densification in a high shear batch mixer/granulator or by a continuous granulation and densification process (e.g. using Lodige(R) CB and/or Lodige(R) KM mixers). Other suitable processes include fluid bed processes, compaction processes (e.g. roll compaction), extrusion, as well as any particulate material made by any chemical process like flocculation, crystallisation sentering, etc. Individual particles can also be any other particle, granule, sphere or grain.

The components of the particulate material may be mixed together by any conventional means. Batch is suitable in, for example, a concrete mixer, Nauta mixer, ribbon mixer or any other. Alternatively the mixing process may be carried out continuously by metering each component by weight on to a moving belt, and blending them in one or more drum(s) or mixer(s). Non-gelling binder can be sprayed on to the mix of some, or all of, the components of the particulate material. Other liquid ingredients may also be sprayed on to the mix of components either separately or premixed. For example perfume and slurries of optical brighteners may be sprayed. A finely divided flow aid (dusting agent such as zeolites, carbonates, silicas) can be added to the particulate material after spraying the binder, preferably towards the end of the process, to make the mix less sticky.

The tablets may be manufactured by using any compacting process, such as tabletting, briquetting, or extrusion, preferably tabletting. Suitable equipment includes a standard single stroke or a rotary press (such as Courtoy(R), Korch (R), Manesty(R), or Bonals(R)). The tablets prepared according to this invention preferably have a diameter of between 20 mm and 60 mm, preferably of at least 35 and up to 55 mm, and a weight between 15 g and 100 g. The ratio of height to diameter (or width) of the tablets is preferably greater than 1:3, more preferably greater than 1:2. The compaction pressure used for preparing these tablets need not exceed 100000 kN/m2, preferably not exceed 30000 kN/m2, more preferably not exceed 5000 kN/m2, even more preferably not exceed 3000 kN/m2 and most preferably not exceed 1000 kN/m2. In a preferred embodiment according to the invention, the tablet has a density of at least 0.9 g/cc, more preferably of at least 1.0 g/cc, and preferably of less than 2.0 g/cc, more preferably of less than 1.5 g/cc, even more preferably of less than 1.25 g/cc and most preferably of less than 1.1 g/cc.

Multi-layer tablets can be made by known techniques.

Coating—Solidity of the tablet according to the invention may be further improved by making a coated tablet, the coating covering a non-coated tablet according to the invention, thereby further improving the mechanical characteristics of the tablet while maintaining or further improving dispersion.

In one embodiment of the present invention, the tablets may then be coated so that the tablet does not absorb moisture, or absorbs moisture at only a very slow rate. The coating is also strong so that moderate mechanical shocks to which the tablets are subjected during handling, packing and shipping result in no more than very low levels of breakage or attrition. Finally the coating is preferably brittle so that the tablet breaks up when subjected to stronger mechanical shock. Furthermore it is advantageous if the coating material is dispersed under alkaline conditions, or is readily emulsified by surfactants. This contributes to avoiding the problem of visible residue in the window of a front-loading washing machine during the wash cycle, and also avoids deposition of particles or lumps of coating material on the laundry load.

Water solubility is measured following the test protocol of ASTM E1148-87 entitled, "Standard Test Method for Measurements of Aqueous Solubility".

Suitable coating materials are dicarboxylic acids. Particularly suitable dicarboxylic acids are selected from the group consisting of oxalic acid, malonic acid, succinic acid, glutaric acid, adipic acid, pimelic acid, suberic acid, azelaic acid, sebacic acid, undecanedioic acid, dodecanedioic acid, tridecanedioic acid and mixtures thereof. The coating material has a melting point preferably of from 40° C. to 200° C.

The coating can be applied in a number of ways. Two preferred coating methods are a) coating with a molten material and b) coating with a solution of the material.

In a), the coating material is applied at a temperature above its melting point, and solidifies on the tablet. In b), the coating is applied as a solution, the solvent being dried to leave a coherent coating. The substantially insoluble material can be applied to the tablet by, for example, spraying or dipping. Normally when the molten material is sprayed on to the tablet, it will rapidly solidify to form a coherent coating. When tablets are dipped into the molten material and then removed, the rapid cooling again causes rapid solidification of the coating material. Clearly substantially insoluble materials having a melting point below 40° C. are not sufficiently solid at ambient temperatures and it has been found that materials having a melting point above about 200° C. are not practicable to use. Preferably, the materials melt in the range from 60° C. to 160° C., more preferably from 70° C. to 120° C.

By "melting point" is meant the temperature at which the material when heated slowly in, for example, a capillary tube becomes a clear liquid.

A coating of any desired thickness can be applied according to the present invention. For most purposes, the coating forms from 1% to 10%, preferably from 1.5% to 5%, of the tablet weight.

The tablet coatings are preferably very hard and provide extra strength to the tablet.

In a preferred embodiment of the present invention the fracture of the coating in the wash is improved by adding a disintegrant in the coating. This disintegrant will swell once in contact with water and break the coating in small pieces. This will improve the dispersion of the coating in the wash solution. The disintegrant is suspended in the coating melt at a level of up to 30%, preferably between 5% and 20%, most preferably between 5 and 10% by weight. Possible disintegrants are described in Handbook of Pharmaceutical Excipients (1986). Examples of suitable disintegrants include starch: natural, modified or pregelatinized starch, sodium starch gluconate; gum: agar gum, guar gum, locust bean gum, karaya gum, pectin gum, tragacanth gum; croscarmylose Sodium, crospovidone, cellulose, carboxymethyl cellulose, algenic acid and its salts including sodium alginate, silicone dioxide, clay, polyvinylpyrrolidone, soy polysacharides, ion exchange resins and mixtures thereof.

Tensile Strength—Depending on the composition of the starting material, and the shape of the tablets, the used compacting force may be adjusted to not affect the tensile strength, and the disintegration time in the washing machine. This process may be used to prepare homogenous or layered tablets of any size or shape.

For a cylindrical tablet, the tensile strength corresponds to the diametrical fracture stress (DFS) which is a way to express the strength of a tablet, and is determined by the following equation:

$$= \frac{2F}{\pi D t}$$

Where F is the maximum force (Newton) to cause tensile failure (fracture) measured by a VK 200 tablet hardness tester supplied by Van Kell industries, Inc. D is the diameter of the tablet, and t the thickness of the tablet.

(Method Pharmaceutical Dosage Forms Tablets Volume 2 Page 213 to 217). A diametral fracture stress of at least 25 kPa is preferred.

This applies similarly to non cylindrical tablets, to define the tensile strength, whereby the cross section normal to the height of the tablet is non round, and whereby the force is applied along a direction perpendicular to the direction of the height of the tablet and normal to the side of the tablet, the side being perpendicular to the non round cross section.

Optional Conventional Detergent Adjunct Ingredients

In addition to the components of the compositions of the present invention hereinabove described, the detergent compositions herein can, and preferably will, contain various other optional components.

(a) Inorganic Detergent Builders—The detergent compositions herein may also optionally contain one or more types of inorganic detergent builders beyond those listed hereinbefore that also function as alkalinity sources. Such optional inorganic builders can include, for example, aluminosilicates such as zeolites. Aluminosilicate zeolites, and their use as detergent builders are more fully discussed in Corkill et al., U.S. Pat. No. 4,605,509; Issued Aug. 12, 1986, the disclosure of which is incorporated herein by reference. Also crystalline layered silicates, such as those discussed in this '509 U.S. patent, are also suitable for use in the detergent compositions herein. If utilized, optional inorganic detergent builders can comprise from about 2% to 15% by weight of the compositions herein.

(b) Enzymes—Enzymes can be included in the formulations herein for a wide variety of fabric laundering purposes, including removal of protein-based, carbohydrate-based, or triglyceride-based stains; for the prevention of refugee dye transfer; and for fabric restoration. It is believed that the addition of the special hydrotropes described above will enhance the performance of enzymes in a detergent composition. This is because as the hydrotropes increase the rate of dissolution of the detergent composition, the rate at which enzymes come into contact with water and are activated will also increase and the corresponding detersive benefits provided by activated enzymes will also increase. This behavior is seen in both aqueous and non-aqueous detergent compositions.

The enzymes to be incorporated include proteases, amylases, lipases, mannanase, cellulases, and peroxidases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1.0% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular strains of *Bacillus subtilis* and *Bacillus licheniforms*. Another suitable protease is obtained from a strain of *Bacillus*, having maximum activity throughout the pH range of 8–12, developed and sold by Novo Industries A/S under the registered trade name ESPERASE®. The preparation of this enzyme and analogous enzymes is described in British Patent Specification No. 1,243,784 of Novo Industries A/S. Proteolytic enzymes suitable for removing protein-based stains that are commercially available include those sold under the tradenames ALCALASE® and SAVINASE® by Novo Industries A/S (Denmark) and MAXATASE® by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al., published Jan. 9, 1985).

Amylases include, for example, amylases described in British Patent Specification No. 1,296,839 (Novo Industries A/S), RAPIDASE®, International Bio-Synthetics, Inc. and TERMAMYL®, Novo Industries A/S.

Mannanases include the following three mannans-degrading enzymes: EC 3.2.1.25: β*mannosidase, EC 3.2.1.78: Endo-1,4-β-mannosidase, referred therein after as "mannanase" and EC 3.2.1.100: 1,4-β-mannobiosidase (IUPAC Classification—Enzyme nomenclature, 1992 ISBN 0-12-227165-3 Academic Press).

More preferably, the detergent compositions of the present invention comprise a β-1,4-Mannosidase (E.C. 3.2.1.78) referred to as Mannanase. The term "mannanase" or "galactomannanase" denotes a mannanase enzyme defined according to the art as officially being named mannan endo-1,4-beta-mannosidase and having the alternative names beta-mannanase and endo-1,4-mannanase and catalysing the reaction: random hydrolysis of 1,4-beta-D-mannosidic linkages in mannans, galactomannans, glucomannans, and galactoglucomannans. In particular, Mannanases (EC 3.2.1.78) constitute a group of polysaccharases which degrade mannans and denote enzymes which are capable of cleaving polyose chains containing mannose units, i.e. are capable of cleaving glycosidic bonds in mannans, glucomannans, galactomannans and galactoglucomannans. Mannans are polysaccharides having a backbone composed of β-1,4-linked mannose; glucomannans are polysaccharides having a backbone or more or less regularly alternating β-1,4 linked mannose and glucose; galactomannans and galactoglucomannans are mannans and glucomannans with α-1,6 linked galactose sidebranches. These compounds may be acetylated.

The cellulase enzymes used in the instant detergent composition are preferably incorporated at levels sufficient to provide up to about 5 mg by weight, more preferably about 0.01 mg to about 3 mg, of active enzyme per gram of the composition. Stated otherwise, the compositions herein preferably comprise from about 0.001% to about 5%, preferably 0.01%–1.0% by weight of a commercial enzyme preparation. The cellulase usable in the present invention includes both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from *Humicola insolens* and *Humicola* strain DSM 1800 or a cellulase 212-producing microorganism belonging to the genus *Aeromonas*, and cellulase extracted from the hepatopancreas of a marine mollusk (*Dolabella Auricula Solander*). Suitable cellulases are also disclosed in GB-A-2.075.028; GB-A-2.095.275 and DE-OS-2.247.832. In addition, cellulase especially suitable for use herein are disclosed in WO 92-13057 (The Procter & Gamble Company). Most preferably, the cellulases used in the instant detergent compositions are purchased commercially from NOVO Industries A/S under the product names CAREZYME® and CELLUZYME®.

Suitable lipase enzymes for detergent usage include those produced by microorganisms of the *Pseudomonas* group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P AMANO®, hereinafter referred to as "Amano-P." Other commercial lipases include AMANO-CES®, lipases from *Chromobacter viscosum*, e.g. *Chromobacter viscosum* var. *lipolyticum* NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases from *Pseudomonas gladioli*. The LIPOLASE® enzyme derived from *Humicola lanuginosa* and commercially available from Novo Industries A/S(see also EPO 341,947) is a preferred lipase for use herein.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al., and European Patent Application Publication No. 0 199 405, Application No. 86200586.5, published Oct. 29, 1986, Venegas. Enzyme stabilization systems are also described, for example, in U.S. Pat. No. 3,519,570. Enzymes added to the compositions herein in the form of conventional enzyme prills are especially preferred for use herein. Such prills will generally range in size from about 100 to 1,000 microns, more preferably from about 200 to 800 microns and will be suspended throughout the liquid phase of the composition. Prills in the compositions of the present invention have been found, in comparison with other enzyme forms, to exhibit especially desirable enzyme stability in terms of retention of enzymatic activity over time. Thus, compositions which utilize enzyme prills need not contain conventional enzyme stabilizing such as must frequently be used when enzymes are incorporated into aqueous liquid detergents.

(c) Chelating Agents—The detergent compositions herein may also optionally contain a chelating agent which serves to chelate metal ions, e.g., iron and/or manganese, within the detergent compositions herein. Such chelating agents thus serve to form complexes with metal impurities in the composition which would otherwise tend to deactivate composition components such as the peroxygen bleaching agent. Useful chelating agents can include amino carboxylates, phosphonates, amino phosphonates, polyfunctionally-substituted aromatic chelating agents and mixtures thereof.

Amino carboxylates useful as optional chelating agents include ethylenediaminetetraacetates, N-hydroxyethylethylenediaminetriacetates, nitrilotriacetates, ethylenediamine tetrapropionates, triethylenetetraaminehexacetates, diethylenetriaminepentaacetates, ethylenediaminedisuccinates and ethanol diglycines. The alkali metal salts of these materials are preferred.

Amino phosphonates are also suitable for use as chelating agents in the compositions of this invention when at least low levels of total phosphorus are permitted in detergent compositions, and include ethylenediaminetetrakis (methylene-phosphonates) as DEQUEST. Preferably, these amino phosphonates do not contain alkyl or alkenyl groups with more than about 6 carbon atoms.

Preferred chelating agents include hydroxyethyldiphosphonic acid (HEDP), diethylene triamine penta acetic acid (DTPA), ethylenediamine disuccinic acid (EDDS) and dipicolinic acid (DPA) and salts thereof. The chelating agent may, of course, also act as a detergent builder during use of the compositions herein for fabric laundering/bleaching. The chelating agent, if employed, can comprise from about 0.1% to 4% by weight of the compositions herein. More preferably, the chelating agent will comprise from about 0.2% to 2% by weight of the detergent compositions herein.

(d) Suds Suppressors—Suds suppression can be of particular importance in the present invention because of the high concentration of the detergent composition. The use of suds suppressors in "high concentration cleaning process" is described in greater detail U.S. Pat. Nos. 4,489,455 and 4,489,574.

A wide variety of materials may be used as suds suppressors, and suds suppressors are well known to those skilled in the art. See, for example, Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acid and soluble salts therein. See U.S. Pat. No. 2,954,347, issued Sep. 27, 1960 to Wayne St. John. The monocarboxylic fatty acids and salts thereof used as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts.

The detergent compositions herein may also contain non-surfactant suds suppressors. These include, for example: high molecular weight hydrocarbons, N-alkylated amino triazines, monostcaryl phosphates, silicone suds suppressors, secondary alcohols (e.g., 2-alkyl alkanols) and mixtures of such alcohols with silicone oils. Hydrocarbon suds suppressors are described, for example, in U.S. Pat. No. 4,265,779, issued May 5, 1981 to Gandolfo et al. Silicone suds suppressors are well known in the art and are, for example, disclosed in U.S. Pat. No. 4,265,779, issued May 5, 1981 to Gandolfo et al and European Patent Application No. 89307851.9, published Feb. 7, 1990, by Starch, M. S. Mixtures of alcohols and silicone oils are described in U.S. Pat. Nos. 4,798,679, 4,075,118 and EP 150,872.

Additional examples of all of the aforementioned suds suppressors may be found in the provisional patent application of Pramod K. Reddy, entitled "Hydrophilic Index for Aqueous, Liquid Laundry Detergent Compositions containing LAS", filed under the Patent Cooperation having P&G Case No. 7332P, filed on Nov. 6, 1998 and having Ser. No. 60/107,477, which is hereby incorporated by reference.

The preferred particulate foam control agent used herein contains a silicone antifoam compound, an organic material and a carrier material onto which the silicone antifoam compound and the organic material are deposited. The carrier material is preferably a native starch or zeolite. The silicone antifoam compound is selected from the group consisting of polydiorganosiloxane, solid silica and mixtures thereof. Preferably, the organic material is selected from:

(a) at least one fatty acid having a carbon chain containing from 12 to 20 carbon atoms, said organic material having a melting point in the range 45° C. to 80° C. and being insoluble in water;

(b) at least one fatty alcohol, having a carbon chain containing from 12 to 20 carbon atoms, said organic material having a melting point in the range 45° C. to 80° C. and being insoluble in water, (c) a mixture of at least one fatty acid and one fatty alcohol, each having a carbon chain containing from 12 to 20 carbon atoms, said organic material having a melting point in the range 45° C. to 80° C. and being insoluble in water, (d) an organic material having a melting point in the range 50° C. to 85° C. and comprising a monoester of glycerol and a fatty acid having a carbon chain containing from 12 to 20 carbon atoms; and (e) a dispersing polymer; and mixtures thereof.

Preferably, the dispersing polymer is selected from the group consisting of copolymers of acrylic acid and maleic acid, polyacrylates and mixtures thereof.

Silicone suds suppressors known in the art which can be used are, for example, disclosed in U.S. Pat. No. 4,265,779, issued May 5, 1981 to Gandolfo et al and European Patent Application No. 89307851.9, published Feb. 7, 1990, by Starch, M. S. Silicone defoamers and suds controlling agents in granular detergent compositions arc disclosed in U.S. Pat. No. 3,933,672, Bartolotta et al, and in U.S. Pat. No. 4,652,392, Baginski et al, issued Mar. 24, 1987. An exemplary silicone based suds suppressor for use herein is a suds suppressing amount of a particulate foam control agent consisting essentially of:

(a) polydimethylsiloxane fluid having a viscosity of from about 20 cs. to about 1,500 cs. at 25° C.;

(b) from about 5 to about 50 parts per 100 parts by weight of (i) of siloxane resin composed of $(CH_3)_3\ SiO_{1/2}$ units of $SiO_2$ units in a ratio of from $(CH_3)_3\ SiO_{1/2}$ units of from about 0.6:1 to about 1.2: 1; and (c) from about 1 to about 20 parts per 100 parts by weight of (i) of a solid silica gel.

Additional suds suppressor suitable for use in the present invention are described in greater detail in U.S. Pat. No. 5,762,647, issued June 9, 1998, to Brown et al.

(e) Dye Transfer Inhibiting Agents and Other Fabric Care Components—The compositions of the present invention may also include one or more materials effective for inhibiting the transfer of dyes from one fabric to another during the cleaning process. These agents may be included either in the nonaqueous surfactant-containing liquid phase or in the solid particulate material.

Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. These agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: R—$A_X$—P; wherein P is a polymerizable unit to which an N—O group can be attached or the N—O group can form part of the polymerizable unit or the N—O group can be attached to both units; A is one of the following structures: —NC(O)—, —(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

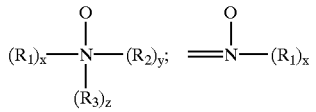

wherein $R_1$, $R_2$, $R_3$ are aliphatic, aromatic, heterocyclic or alicyclic groups or combinations thereof; x, y and z are 0 or 1; and the nitrogen of the N—O group can be attached or form part of any of the aforementioned groups. The amine oxide unit of the polyamine N-oxides has a pKa<10, preferably pKa<7, more preferred pKa<6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and mixtures thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000.

The most preferred polyamine N-oxide useful in the detergent compositions herein is poly(4-vinylpyridine-N-oxide) which as an average molecular weight of about 50,000 and an amine to amine N-oxide ratio of about 1:4. This preferred class of materials can be referred to as "PVNO".

Further suitable dye transfer inhibitors can be found in U.S. Pat. No. 5,466,802, issued Nov. 14, 1995 to Panandiker et al., which is hereby incorporated by reference.

In addition to the dye transfer inhibitors, the present invention further comprises additional agents to provide fabric care benefits. As described above, these additional agents may be necessary because the high concentrations of detergent concentration in the aqueous laundering solutions used in the present invention may damaged the garments and fabrics contact by the aqueous laundering solutions.

Thus the present invention may also include materials which could be added to laundry products that would associate themselves with the fibers of the fabrics and textiles laundered using such products and thereby reduce or minimize the tendency of the laundered fabric/textiles to deteriorate in appearance. Any such detergent product additive material should, of course, be able to benefit fabric appearance and integrity without unduly interfering with the ability of the laundry product to perform its intended function. Such fabric appearance benefits can include, for example, improved overall appearance of the laundered fabrics, reduction of the formation of pills and fuzz, protection against color fading, improved abrasion resistance, etc.

One such fabric care agent which specifically acts to prevent dyes from migrating from the surface of a garment and into the aqueous laundering solution but also provides other fabric care benefits is 30 polyethyleneimine, PEI 600 E20, having the general formula:

$$[E_2NCH_2CH_2]_w[\overset{\overset{E}{|}}{N}CH_2CH_2]_x[\overset{\overset{B}{|}}{N}CH_2CH_2)_yNE_2$$

wherein B is a continuation by branching of the polyethyleneimine backbone. E is an ethyleneoxy unit having the formula:

$$—(CH_2CH_2O)mH$$

wherein m has an average value of about 20. What is meant herein by an average value of 20 is that sufficient ethylene oxide or other suitable reagent is reacted with the polyethyleneimine starting material to fully ethoxylate each N—H unit to a degree of 20 ethoxylations. However, those skilled in the art will realize that some N—H unit hydrogen atoms will be replaced by less than 20 ethoxy units and some will be replaced by more than 20 ethoxy units, therefore, the average of the number of ethoxylations is 20.

The units which make up the polyalkyleneimine backbones are primary amine units having the formula:

$$H_2N—CH_2CH_2]— \text{ and } —NH_2$$

which terminate the main backbone and any branching chains, secondary amine units having the formula:

$$—[\overset{\overset{H}{|}}{N}—CH_2CH_2]—$$

and which, after modification, have their hydrogen atom substituted by an average of 20 ethyleneoxy units, and tertiary amine units having the formula:

$$—[\overset{\overset{B}{|}}{N}—CH_2CH_2]—$$

which are the branching points of the main and secondary backbone chains, B representing a continuation of the chain structure by branching. The tertiary units have no replaceable hydrogen atom and are therefore not modified by substitution with ethyleneoxy units. During the formation of the polyamine backbones cyclization may occur, therefore, an amount of cyclic polyamine can be present in the parent polyalkyleneimine backbone mixture. Each primary and secondary amine unit of the cyclic alkyleneimines undergoes modification by the addition of alkyleneoxy units in the same manner as linear and branched polyalkyleneimines.

The indices w, x, and y have values such that the average molecular weight of the polyethyleneimine backbone prior to modification is about 600 daltons. In addition, those skilled in the art will recognize that each branch chain must terminate in a primary amine unit, therefore the value of the index w is y+1 in the case where no cyclic amine backbones are present. The average molecular weight for each ethylene backbone unit, $—NCH_2CH_2—$, is approximately 43 daltons.

The polyamines of the present invention can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951; all herein incorporated by reference.

Other suitable fabric care agents for use in the present detergent compositions include dye maintenance polymers. One example of such a polymer is the Adduct of Imidazole-epichlorohydrin:

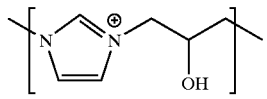

(Idealized Structure)

This has a ratio of imidazole:epichlorohydrin of 1.36:1. Further dye maintenance polymers as well as the Dye Maintenance Parameter Test are described in the copending provisional application of Rajan K. Panandiker et al., entitled "Laundry Detergent Compositions with a Cationically Charged Dye Maintenance Polymer," having P&G Case No. 7488P and Ser. No. 60/126,074, filed on march 25, 1999, which is hereby incorporated by reference. As described above, these dye maintenance polymers provide overall fabric care benefits in addition to color care protection.

(f) Thickening, Viscosity Control and/or Dispersing Agents—The detergent compositions herein may also optionally contain a polymeric material which serves to enhance the ability of the composition to maintain its solid particulate components in suspension. Such materials may thus act as thickeners, viscosity control agents and/or dispersing agents. Such materials are frequently polymeric polycarboxylates but can include other polymeric materials such as polyvinylpyrrolidone (PVP) or polyamide resins.

Polymeric polycarboxylate materials can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight of the polymer.

Particularly suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 100,000, more preferably from about 2,000 to 10,000, even more preferably from about 4,000 to 7,000, and most preferably from about 4,000 to 5,000. Water-soluble salts of such acrylic acid polymers can include, for example, the alkali metal, salts. Soluble polymers of this type are known materials. Use of polyacrylates of this type in detergent compositions has been disclosed, for example, Diehl, U.S. Pat. No. 3,308,067, issued Mar. 7, 1967. Such materials may also perform a builder function.

Other suitable polymeric materials suitable for use as thickening, viscosity control and/or dispersing agents include polymers of: castor oil derivatives; polyurethane derivatives, and polyethylene glycol.

If utilized, the optional thickening, viscosity control and/or dispersing agents should be present in the compositions herein to the extent of from about 0.1% to 4% by weight. More preferably, such materials can comprise from about 0.1% to 2% by weight of the detergents compositions herein.

(g) Clay Soil Removal/Anti-redeposition Agents—The compositions of the present invention can also optionally contain water-soluble ethoxylated amines having clay soil removal and anti-redeposition properties. If used, soil materials can contain from about 0.01% to about 5% by weight of the compositions herein.

The most preferred soil release and anti-redeposition agent is ethoxylated tetraethylenepentamine. Exemplary ethoxylated amines are further described in U.S. Pat. No. 4,597,898, VanderMeer, issued Jul. 1, 1986. Another group of preferred clay soil removal-anti-redeposition agents are the cationic compounds disclosed in European Patent Application 111,965, Oh and Gosselink, published Jun. 27, 1984. Other clay soil removal/anti-redeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Preferred clay-removing compounds include ethoxylated quaternized amines. Preferred ethoxylated quaternized amine materials are selected from the group consisting of compounds having the general formula:

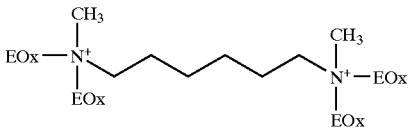

wherein each x is independently less than about 16, preferably from about 6 to about 13, more preferably from about 6 to about 8, or wherein each x is independently greater than about 35. Materials suitable for use in the present invention, such as those defined above, can be purchased from the BASF Corporation in Germany, and the Witco Chemical Company.

It has been determined that the degree of ethoxylation is important to the viscosity of the final detergent compositions described herein. Specifically, for the general structure:

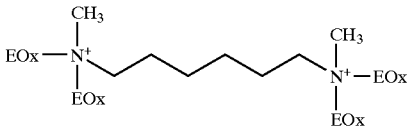

when x is less than about 13 the ethoxylated quaternized amine clay materials can be added to the present liquid heavy duty detergent compositions as liquids without causing undesired thickening at low temperatures. Likewise, when the degree of ethoxylation for the same structure is greater than about 35, that is when x is greater than about 35, these higher ethoxalated materials can be added to the formulations as stable solid without melting at high temperatures and without causing low temperature product thickening.

Of course, it will be appreciated that other, conventional optical brightener types of compounds can optionally be used in the present compositions to provide conventional fabric "brightness" benefits, rather than a true dye transfer inhibiting effect. Such usage is conventional and well-known to detergent formulations.

Other clay soil removal and/or anti-redeposition agents known in the art can also be utilized in the compositions herein. Another type of preferred anti-redeposition agent includes the carboxy methyl cellulose (CMC) materials. These materials are well known in the art.

(h) Liquid Bleach Activators—The detergent compositions herein may also optionally contain bleach activators which are liquid in form at room temperature and which can be added as liquids to the liquid phase of the detergent compositions herein. One such liquid bleach activator is glycerol triacetate, which serves as a solvent in the composition during storage but when released into the wash water solution is peroxidized and functions as a bleach activator. Other examples of bleach activators include acetyl triethyl citrate (ATC) and nonanoyl valerolactam. Liquid bleach activators can be dissolved in the liquid phase of the compositions herein.

(i) Brighteners, Dyes and/or Perftimes—The detergent compositions herein may also optionally contain conventional brighteners, bleach catalysts, dyes and/or perfume materials. Such brighteners, silicone oils, bleach catalysts, dyes and perfumes must, of course, be compatible and non-reactive with the other composition components in the aqueous or non-aqueous liquid environment. If present, brighteners, dyes and/or perfumes will typically comprise from about 0.0001% to 2% by weight of the compositions herein.

(j) Structure Elasticizing Agents—The liquid detergent compositions herein can also contain from about 0.1% to 5%, preferably from about 0.1% to 2% by weight of a finely divided, solid particulate material which can include silica, e.g., fumed silica, titanium dioxide, insoluble carbonates, finely divided carbon, SD-3 bentone, clays, or combinations of these materials. Clays are well known to those skilled in the art and are commercially available from companies such as Rheox. Fine particulate material of this type functions as a structure elasticizing agent in the products of this invention. Such material has an average particle size ranging from about 7 to 40 nanometers, more preferably from about 7 to 15 nanometers. Such material also has a specific surface area which ranges from about 40 to 400 $m^2/g$.

The finely divided elasticizing agent material can improve the shipping stability of the liquid detergent products herein by increasing the elasticity of the surfactant-structured liquid phase without increasing product viscosity. This permits such products to withstand high frequency vibration which may be encountered during shipping without undergoing undesirable structure breakdown which could lead to sedimentation in the product.

In the case of titanium dioxide, the use of this material also imparts whiteness to the suspension of particulate material within the detergent compositions herein. This effect improves the overall appearance of the product.

(k) Microspheres—Microspheres may be used in the present invention. Suitable microspheres may be made of one or more water-insoluble materials selected from the group consisting of: polymers; silicaceous materials; ceramics and mixtures thereof. For further discussion of microspheres, see "Microencapsulation" in Kirk-Othmer Encyclopedia of Chemical Technology, Third Edition, Volume 16, pages 628–651 (John Wiley & Sons, Inc., 1979), which is hereby incorporated by reference.

Polymer microspheres of the present invention are preferably made of a water-insoluble material selected from the group consisting of: thermoplastics; acylonitrile; methacrylonitrile; polyacrylonitrile; polymethacrylonitrile and mixtures thereof. Silicaceous microspheres of the present invention are preferably made of one or more silicaceous materials selected from the group consisting of glass. Borosilicate glass is particularly preferred.

Commercially available microspheres are available from Akzo-Nobel of Sweden under the trademark EXPANCEL®; PQ Corp. under the trade names PM 6545, PM 6550, PM 7220, PM 7228, EXTENDOSPHERES®, LUXSIL®, Q-CEL®, SPHERICEL®; and Malinckrodt under the trademark ALBUMEX®.

Suitable examples of microspheres and further disclosure on microsphere-containing liquid detergents may be found in copending provisional patent applications of Broeckx et al., entitled "Stable Non-aqueous Liquid Laundry Detergents Comprising Low Density Particles", having P & G Case No. 7417P, provisional Ser. No. 60/119,555 and filed on Feb. 10, 1999, which is hereby incorporated by reference.

In addition to the types of micospheres discussed above, suitable microspheres for use in the present invention may also be made from wash-water soluble biomaterials (such as starches and proteins) which are disclosed in greater detail in the copending provisional patent application of Sadlowski et al., entitled "Nonaqueous Liquid Detergent with Wash-water soluble Low-Density Filler Particles", having P&G Case No. 7707P, and filed on Aug. 10, 1999, which is hereby incorporated by reference.

In addition, the microspheres used in the present invention may be used as the core of a particle which is formed by substantially encapsulating the core with detergent components. A non-exclusive list of such components includes organic and inorganic builder material, alkalinity source material and other coating components. These coated microspheres are disclosed with greater specificity in the copending provisional patent application of Aouad et al., entitled "Nonaqueous Liquid Detergent with Wash-water soluble Low-Density Filler Particles", having P&G Case No. 7708P, and filed on Aug. 10, 1999, which is hereby incorporated by reference. Coated microspheres are also discussed in the copending provisional application of Sadlowski et al, P&G Case No. 7707P, incorporated above.

(i) Effervescent—In another preferred embodiment of the present invention the tablets further comprises an effervescent.

Effervescency as defined herein means the evolution of bubbles of gas from a liquid, as the result of a chemical reaction between a soluble acid source and an alkali metal carbonate, to produce carbon dioxide gas, $$\text{i.e. } C_6H_8O^7+3NaHCO_{33}\ Na_3C^6H_5O_7+3CO_2+3H_2O$$

Further examples of acid and carbonate sources and other effervescent systems may be found in: (Pharmaceutical Dosage Forms: Tablets Volume 1 Page 287 to 291).

An effervescent may be added to the tablet mix in addition to the detergent ingredients. The addition of this effervescent to the detergent tablet improves the disintegration time of the tablet. The amount will preferably be between 5 and 20% and most preferably between 10 and 20% by weight of the tablet. Preferably the effervescent should be added as an agglomerate of the different particles or as a compact, and not as separated particles.

Due to the gas created by the effervescency in the tablet, the tablet can have a higher D.F.S. and still have the same disintegration time as a tablet without effervescency. When the D.F.S. of the tablet with effervescency is kept the same as a tablet without, the disintegration of the tablet with effervescency will be faster.

Further dispersion aid could be provided by using compounds such as sodium acetate or urea. A list of suitable dispersion aid may also be found in Pharmaceutical Dosage Forms: Tablets, Volume 1, Second edition, Edited by H. A. Lieberman et all, ISBN 0-8247-8044-2.

The effervescent system may comprise and acid and a base, such as citric acid and sodium bicarbonate, and/or the effervescent system may comprise an enzyme, such as catalase and/or peroxidase and a source of peroxide, such as hydrogen peroxide.

(m) Binders—Non gelling binders can be integrated to the particles forming the tablet in order to further facilitate dispersion.

If non gelling binders are used, suitable non-gelling binders include synthetic organic polymers such as polyethylene glycols, polyvinylpyrrolidones, polyacrylates and water-soluble acrylate copolymers. The handbook of Pharmaceutical Excipients second edition, has the following binders classification: *Acacia*, Alginic Acid, Carbomer, Carboxymethylcellulose sodium, Dextrin, Ethylcellulose, Gelatin, Guar gum, Hydrogenated vegetable oil type I, Hydroxyethyl cellulose, Hydroxypropyl methylcellulose, Liquid glucose, Magnesium aluminum silicate, Maltodextrin, Methylcellulose, polymethacrylates, povidone, sodium alginate, starch and zein. Most preferable binders also have an active cleaning function in the laundry wash such as cationic polymers, i.e. ethoxylated hexamethylene diamine quaternary compounds, bishexamethylene triamines, or others such as pentaamines, ethoxylated polyethylene amines, maleic acrylic polymers.

Non-gelling binder materials are preferably sprayed on and hence have an appropriate melting point temperature below 90° C., preferably below 70° C. and even more preferably below 50° C. so as not to damage or degrade the other active ingredients in the matrix. Most preferred are non-aqueous liquid binders (i.e. not in aqueous solution) which may be sprayed in molten form. However, they may also be solid binders incorporated into the matrix by dry addition but which have binding properties within the tablet.

Non-gelling binder materials are preferably used in an amount within the range from 0.1 to 15% of the composition, more preferably below 5% and especially if it is a non laundry active material below 2% by weight of the tablet.

It is preferred that gelling binders, such as nonionic surfactants are avoided in their liquid or molten form. Nonionic surfactants and other gelling binders are not excluded from the compositions, but it is preferred that they be processed into the detergent tablets as components of particulate materials, and not as liquids.

(n) Clays—The clay minerals used to provide the softening properties of the instant compositions can be described as expandable, three-layer clays, i.e., alumino-silicates and magnesium silicates, having an ion exchange capacity of at least 50 meq/100 g. of clay. The term "expandable" as used to describe clays relates to the ability of the layered clay structure to be swollen, or expanded, on contact with water. The three-layer expandable clays used herein are those materials classified geologically as smectites.

There are two distinct classes of smectite-type clays; in the first, aluminum oxide is present in the silicate crystal lattice; in the second class of smectites, magnesium oxide is present in the silicate crystal lattice. The general formulas of these smectites are $Al_2(Si_2O_5)_2(OH)_2$ and $Mg_3(Si_2O_5)$ $(OH)_2$ for the aluminum and magnesium oxide type clay, respectively. It is to be recognised that the range of the water of hydration in the above formulas can vary with the processing to which the clay has been subjected. This is immaterial to the use of the smectite clays in the present invention in that the expandable characteristics of the hydrated clays are dictated by the silicate lattice structure. Furthermore, atom substitution by iron and magnesium can occur within the crystal lattice of the smectites, while metal cations such as Na+, Ca++, as well as H+, can be co-present in the water of hydration to provide electrical neutrality. Except as noted hereinafter, such cation substitutions are immaterial to the use of the clays herein since the desirable physical properties of the clays are not substantially altered thereby.

The three-layer, expandable alumino-silicates useful herein are further characterised by a dioctahedral crystal lattice, while the expandable three-layer magnesium silicates have a trioctahedral crystal lattice.

As noted herein above, the clays employed in the compositions of the instant invention contain cationic counterions such as protons, sodium ions, potassium ions, calcium ion, magnesium ion, and the like. It is customary to distinguish between clays on the basis of one cation predominantly or exclusively absorbed. For example, a sodium clay is one in which the absorbed cation is predominantly sodium. Such absorbed cations can become involved in exchange reactions with cations present in aqueous solutions. A typical exchange reaction involving a smectite-type clay is expressed by the following equation:

$$\text{smectite clay (Na)} + NH_4OH _ \text{smectite clay } (NH_4) + NaOH.$$

Since in the foregoing equilibrium reaction, one equivalent weight of ammonium ion replaces an equivalent weight of sodium, it is customary to measure cation exchange capacity (sometimes termed "base exchange capacity") in terms of milliequivalents per 100 g. of clay (meq./100 g.). The cation exchange capacity of clays can be measured in several ways, including by electrodialysis, by exchange with ammonium ion followed by titration or by a methylene blue procedure, all as fully set forth in Grimshaw, "The Chemistry and Physics of Clays", pp. 264–265, Interscicnce (1971). The cation exchange capacity of a clay mineral relates to such factors as the expandable properties of the clay, the charge of the clay, which, in turn, is determined at least in part by the lattice structure, and the like. The ion exchange capacity of clays varies widely in the range from about 2 meq/100 g, for kaolinites to about 150 meq/100 g., and greater, for certain clays of the montmorillonite variety. Illite clays have an ion exchange capacity somewhere in the lower portion of the range, i.e., around 26 meq/100 g. for an average illite clay.

Illite and kaolinite clays, with their relatively low ion exchange capacities, are preferably not used as the clay in the instant compositions. Indeed, such illite and kaolinite clays constitute a major component of clay soils and, as noted above, are removed from fabric surfaces by means of the instant compositions. However, smectites, such as nontonite, having an ion exchange capacity of around 70 meq/100 g., and montmorillonite, which has an ion exchange capacity greater than 70 meq/100 g., have been found to be useful in the instant compositions in that they are deposited on the fabrics to provide the desired softening benefits. Accordingly, clay minerals useful herein can be characterised as expandable, three-layer smectite-type clays having an ion exchange capacity of at least about 50 meq/100 g.

While not intending to be limited by theory, it appears that advantageous softening (and potentially dye scavenging, etc.) benefits of the instant compositions are obtainable and are ascribable to the physical characteristics and ion exchange properties of the clays used therein. That is to say, experiments have shown that non-expandable clays such as the kaolinites and the illites, which are both classes of clays having an ion exchange capacities below 50 meq/100 g., do not provide the beneficial aspects of the clays employed in the instant compositions.

The smectite clays used in the compositions herein are all commercially available. Such clays include, for example, montmorillonite, volchonskoite, nontronite, hectorite, saponite, sauconite, and vermiculite. The clays herein are available under various tradenames, for example, Thixogel #1 and Gelwhite GP from Georgia Kaolin Co., Elizabeth, New Jersey; Volclay BC and Volclay #325, from American Colloid Co., Skokie, Illinois; Black Hills Bentonite BH450, from International Minerals and Chemicals; and Veegum Pro and Veegum F, from R. T. Vanderbilt. It is to be recognised that such smectite-type minerals obtained under the foregoing tradenames can comprise mixtures of the various discrete mineral entities. Such mixtures of the smectite minerals are suitable for use herein.

While any of the smectite-type clays having a cation exchange capacity of at least about 50 meq/100 g. are useful herein, certain clays are preferred. For example, Gelwbite GP is an extremely white form of smectite clay and is therefore preferred when formulating white granular detergent compositions. Volclay BC, which is a smectite-type clay mineral containing at least 3% of iron (expressed as $Fe_2O_3$) in the crystal lattice, and which has a very high ion exchange capacity, is one of the most efficient and effective clays for use in laundry compositions and is preferred from the standpoint of product performance.

Appropriate clay minerals for use herein can be selected by virtue of the fact that smectites exhibit a true 14 Å x-ray diffraction pattern. This characteristic pattern, taken in combination with exchange capacity measurements performed in the manner noted above, provides a basis for selecting particular smectite-type minerals for use in the granular detergent compositions disclosed herein.

The clay is preferably mainly in the form of granules, with at least 50% (and preferably at least 75% or at least 90%) being in the form of granules having a size of at least 100 mm up to 1800 mm, preferably up to 1186 mm, preferably 150–850 mm. Preferably the amount of clay in the granules is at least 50%, usually at least 70% or 90%, of the weight of the granules.

(O) Flocculants—Most clay flocculating polymers are fairly long chained polymers and co-polymers derived from such monomers as ethylene oxide, acrylamide, acrylic acid, dimethylamino ethyl methacrylate, vinyl alcohol, vinyl pyrrolidone and ethylene imine. Gums, like guar gum, are suitable as well.

Preferred are polymers of ethylene oxide, acrylamide or acrylic acid. These polymers dramatically enhance the deposition of a fabric softening clay if their molecular weights are in the range of from 100 000 to 10 million. Preferred are such polymers having a weight average molecular weight of from 150000 to 5 million.

The most preferred polymer is poly (ethylene oxide). Molecular weight distributions can be readily determined using gel permeation chromatography, against standards of poly (ethylene oxide) of narrow molecular weight distributions.

The amount of flocculant is preferably 0.5–10% by weight of the tablet, most preferably about 2 to 6%.

The flocculant is preferably mainly in the form of granules, with at least 50% by weighty (and preferably at least 75% and most preferably at least 90%) being in the form of granules having a size of at least 100 mm up to 1800 mm, preferably up to 1180 mm and most preferably 150–850 mm. Preferably the amount of flocculant in the granules is at least 50%, generally at least 70% or 90%, of the weight of the granules.

Other components which are commonly used in detergent compositions and which may be incorporated into the detergent tablets of the present invention include chelating agents, soil release agents, soil antiredeposition agents, dispersing agents, brighteners, suds suppressors, fabric softeners, dye transfer inhibition agents and perfumes.

It should be noted that when a clay material is compressed prior to incorporation into a tablet or in a cleaning composition, improved disintegration or dispensing is achieved. For example, tablets comprising clay which is compressed prior to incorporation into a tablet, disintegrate more rapidly than tablets comprising the same clay material which has not been compressed prior to incorporation into a tablet. In particular the amount of pressure used for the compression of the clay is of importance to obtain clay particles which aid disintegration or dispensing.

Further, when softening clays are compressed and then incorporated in cleaning compositions or tablets, not only improved disintegration or dispensing is obtained, but also good softening of the fabrics. Preferably, the clay component is obtained by compression of a clay material.

A preferred process comprises the steps of submitting the clay material to a pressure of at least 10 MPa, or even at least 20 MPa or even 40 MPa. This can for example be done by tabletting or roller compaction of a clay material, optionally together with one or more other ingredients, to form a clay tablet or sheet, preferably followed by size reduction, such as grinding, of the compressed clay sheet or tablet, to form compressed clay particles. The particles can then be incorporated in a tablet or cleaning composition.

Tabletting methods and roller compaction methods are known in the art. For example, the compression of the clay can be done in a Lloyd 50K tablet press or with a Chilsonator roller compaction equipment, available form Fitzpatrick Company.

In order to make the present invention more readily understood, reference is made to the following example, which is intended to be illustrative only and not intended to be limiting in scope.

The following examples are presented for illustrative purposes only and are not to be construed as limiting the scope of the appended claims in any way.

Abbreviations Used in Examples

In the detergent compositions, the abbreviated component identifications have the following meanings:

| | |
|---|---|
| LAS: | Sodium linear C11–13 alkyl benzene sulfonate |
| TAS: | Sodium tallow alkyl sulfate |
| C45AS: | Sodium C14–C15 alkyl sulfate |
| C45E3S: | Sodium C14–C15 alkyl sulfate condensed with 3 moles of ethylene oxide |
| QAS: | R2.N+(CH3)2(C2H4OH) with R2 = C12–C14 |
| Soap: | Sodium linear alkyl carboxylate derived from an 80/20 mixture of tallow and coconut fatty acids |
| Zeolite A: | Hydrated sodium aluminosilicate of formula Na12(AlO2SiO2)12.27H2O having a primary particle size in the range from 0.1 to 10 micrometers (weight expressed on an anhydrous basis) |

-continued

| | |
|---|---|
| NaSKS-6: | Crystalline layered silicate of formula d-Na2Si2O5 |
| Citric acid: | Anhydrous citric acid |
| Carbonate: | Anydrous sodium carbonate with a particle size between 200 μm and 900 μm |
| Bicarbonate: | Anhydrous sodium bicarbonate with a particle size distribution between 400 μm and 1200 μm |
| Silicate: | Amorphous sodium silicate (SiO2:Na2O = 2.0:1) |
| Sulfate: | Anhydrous sodium sulfate |
| Mg sulfate: | Anhydrous magnesium sulfate |
| Citrate: | Tri-sodium citrate dihydrate of activity 86.4% with a particle size distribution between 425 μm and 850 μm |
| MA/AA: | Copolymer of 1:4 maleic/acrylic acid, average molecular weight about 70,000 |
| AA: | Sodium polyacrylate polymer of average molecular weight 4,500 |
| CMC: | Sodium carboxymethyl cellulose |
| Protease: | Proteolytic enzyme, having 4% by weight of active enzyme, as described in WO 95/10591, sold by Genencor Int. Inc. |
| Cellulase: | Cellulytic enzyme, having 0.23% by weight of active enzyme, sold by NOVO Industries A/S under the tradename Carezyme |
| Amylase: | Amylolytic enzyme, having 1.6% by weight of active enzyme, sold by NOVO Industries A/S under the tradename Termamyl 120T |
| Lipase: | Lipolytic enzyme, having 2.0% by weight of active enzyme, sold by NOVO Industries A/S under the tradename Lipolase |
| Perborate: | Sodium perborate |
| Percarbonate: | Sodium percarbonate |
| NOBS: | Nonanoyloxybenzene sulfonate in the form of the sodium salt |
| NACOBS: | (6-nonamidocaproyl) oxybenzene sulfonate |
| TAED: | Tetraacetylethylenediamine |
| DTPA: | Diethylene triamine pentaacetic acid |
| EDDS: | Ethylenediamine-N,N'-disuccinic acid, (S,S) isomer in the form of its sodium salt. |
| Photoactivated: | Sulfonated zinc phthlocyanine encapsulated in bleach (1) dextrin soluble polymer |
| CHDM: | 1,4 CycloHexaneDiMethanol |
| Brightener: | Disodium 4,4'-bis(4-anilino-6-morpholino-1.3.5-triazin-2-yl) amino) stilbene-2:2'-disulfonate |
| HEDP: | 1,1-hydroxyethane diphosphonic acid |
| PEGx: | Polyethylene glycol, with a molecular weight of x (typically 4,000) |
| QEA: | bis((C2H5O)(C2H4O)n)(CH3)-N+-C6H12-N+-(CH3) bis((C2H5O)-(C2H4O))n, wherein n = from 20 to 30 |
| SRP: | Diethoxylated poly (1, 2 propylene terephtalate) short block polymer |
| Silicone antifoam: | Polydimethylsiloxane foam controller with siloxane-oxyalkylene copolymer as dispersing agent with a ratio of said foam controller to said dispersing agent of 10:1 to 100:1 |

In the following examples all levels are quoted as % by weight of the composition:

LIQUID PRODUCT FORMULATION EXAMPLES

Example I

Nonaqueous liquid detergent compositions comprising a surfactant-rich liquid phase and a solid phase were prepared as follows:

| | %, By weight | |
|---|---|---|
| | Composition A | Composition B |
| Nonionic Surfactant | 21.27 | 20.14 |
| BPP Solvent | 18.30 | 17.33 |
| LAS Surfactant | 15.83 | 14.99 |

-continued

| | %, By weight | |
|---|---|---|
| | Composition A | Composition B |
| Ethoxylated quaternized amine clay material | 1.29 | 1.22 |
| Hydrotrope | 4.80 | 0.00 |
| Na-Citrate dihydrate | 6.73 | 6.37 |
| Na-Carbonate | 9.89 | 9.37 |
| Bleach Activator | 5.94 | 5.62 |
| Sodium Perborate | 11.87 | 11.24 |
| EDDS | 1.17 | 1.11 |
| Duramyl Enzyme | 0.79 | 0.87 |
| Carezyme Enzyme | 0.03 | 0.03 |
| Protease Enzyme | 0.79 | 0.75 |
| Antifoaming Agents | 0.61 | 0.85 |
| Plastic Microspheres | 0.51 | 0.49 |
| Titanium dioxide | 0.50 | 0.47 |
| Brightener | 0.20 | 0.19 |
| PEG 8000 | 0.40 | 0.38 |
| Perfume | 1.72 | 1.63 |
| Miscellaneous | 2.16 | 2.15 |

Liquid detergent composition A is prepared according to the present invention and thus contains the preferred hydrotrope 1,4 Cyclo Hexane Di Methanol. As can be seen above, liquid detergent composition B is nearly identical to composition A, except that composition B contains none of the hydrotrope and its other components have been slightly rebalanced.

The benefits of the hydrotropes discussed herein can be readily seen through an experimental test which measures the rate of dissolution of a liquid detergent composition in water.

Rate of Liquid Detergent Product Dissolution in Water Test

1. Fill a glass beaker with 3 liters of deionised water at approximately 25° C.
2. Insert a 5 cm magnetic stirbar and a conductivity electrode into the water. Begin mixing the water rate at a rate of 400 rpm and maintain this constant rate throughout the experiment.
3. Place an 85 ml-capacity screen cup with a 60 mesh screen on the surface of the water and in the center of the beaker in such a way so that the top of the cup is just above the water and no water can come in from the top side, only through the screen.
4. Very slowly add 1 ml of the liquid detergent product (via a syringe) into the middle of the screen cup. This is $T_0$. Measure the conductivity at $T_0$.
5. Repeat the measurement of the electrical conductivity of the detergent product-water mixture at regular intervals, such as after 0.5, 1, 2, 4, 6 and 10 minutes.
6. After a suitable amount of time (e.g. 10 minutes) the liquid detergent product that remains inside the screen cap is added to the product-water mixture by immersing the cap into the mixture and increasing the rate of stirring.
7. When all of the product has been dissolved and the conductivity has reached a steady-state value, said value is recorded.

Both of these compositions were tested using the "Rate of Liquid Detergent Product Dissolution in Water Test" described in great detail above. The conductivity was measured by electrode immersed in the water at the beginning of the test-detergent composition solution and the % of dissolution by and converted into The following results were obtained:

| | Composition A | | Composition B | |
|---|---|---|---|---|
| Time | Conductivity | % Dissolution | Conductivity | % Dissolution |
| 0 s ($T_0$) | 0 | 0 | 0 | 0 |
| 30 s | 28 | 19 | 12 | 7 |
| 60 s | 40 | 27 | 17 | 10 |
| 120 s | 54 | 37 | 23 | 14 |
| 180 s | 62 | 42 | 31 | 18 |
| 240 s | 68 | 47 | 39 | 23 |
| 360 s | 78 | 53 | 44 | 26 |
| 600 s | 81 | 55 | 49 | 29 |
| 660 s | 91 | 62 | 51 | 30 |

After 11 minutes, full dissolution of the detergent composition was forced by high agitation and the conductivity measured:

| | | | | |
|---|---|---|---|---|
| Full Dissolution | 100 | 100 | 146 | 100 |

The dissolution values were obtained by dividing the measured conductivity at each individual time by the measured conductivity at full dissolution and multiplying by 100.

Example II

An aqueous liquid detergent composition according to the present invention is prepared as follows:

| Component | Composition C Wt. % |
|---|---|
| $C_{12-15}$ alkyl ether (2.5) sulfate | 18.0 |
| $C_{12-13}$ alkyl ethoxylate (9.0) | 2.00 |
| $C_{12-14}$ glucose amide | 3.50 |
| Citric Acid | 3.00 |
| $C_{12-14}$ Fatty Acid | 2.00 |
| CHDM | 5.00 |
| MEA | to pH 8 |
| Ethanol | 3.0 |
| Propanediol | 6.0 |
| Dye, Perfume, Brighteners, Enzymes, Preservatives, Suds Suppressor, Other Minors, Water | Balance |
| | 100% |

Example III

Nonaqueous liquid detergent compositions comprising a surfactant-rich liquid phase and a solid phase were prepared as follows:

| | %, By weight | | | | |
|---|---|---|---|---|---|
| | Composition A | Composition B | Composition C | Composition D | Composition E |
| NaLAS | 14.6 | 14.9 | 13.9 | 13.0 | 14.9 |
| HLAS | 0.0 | 0.0 | 1.0 | 1.9 | 0.0 |
| Nonionic Surfactant | 20.6 | 20.7 | 20.7 | 20.7 | 20.7 |
| NaCitrate dihydrate | 3.3 | 3.3 | 3.3 | 3.3 | 3.3 |
| Copolymer of Acrylic Acid and Maleic Acid | 2.9 | 2.9 | 2.9 | 2.9 | 2.9 |
| EDDS | 1.2 | 1.2 | 1.2 | 1.2 | 1.2 |
| Ethoxylated Quarternized amine clay material | 1.3 | 1.3 | 1.2 | 1.3 | 1.3 |
| Sodium Perborate | 11.5 | 11.5 | 11.5 | 11.5 | 11.5 |
| Bleach Activator | 2.9 | 5.8 | 2.9 | 2.9 | 2.9 |
| Triacetin | 12.5 | 0.0 | 12.5 | 12.5 | 8.7 |
| NaCarbonate | 9.6 | 9.6 | 9.6 | 9.6 | 9.6 |
| BPP Solvent | 9.1 | 17.8 | 9.1 | 9.1 | 12.0 |
| Hydrotrope | 3.8 | 4.8 | 3.8 | 3.8 | 4.8 |
| Acetic acid | 0.2 | 0.0 | 0.1 | 0.0 | 0.0 |
| Protease Enzyme | 0.8 | 0.8 | 0.8 | 0.8 | 0.8 |
| Duramyl Enzyme | 0.8 | 0.4 | 0.4 | 0.4 | 0.4 |
| Mannanase Enzyme | 0.2 | 0.2 | 0.2 | 0.2 | 0.2 |
| Carezyme Enzyme | 0.1 | 0.0 | 0.0 | 0.0 | 0.0 |

-continued

| | %, By weight | | | | |
|---|---|---|---|---|---|
| | Composition A | Composition B | Composition C | Composition D | Composition E |
| Brightener | 0.2 | 0.2 | 0.2 | 0.2 | 0.2 |
| Titanium Dioxide | 0.5 | 0.5 | 0.5 | 0.5 | 0.5 |
| PEG 8000 | 0.5 | 0.5 | 0.5 | 0.5 | 0.5 |
| Perfume | 1.7 | 1.7 | 1.7 | 1.7 | 1.7 |
| Silicone | 0.7 | 0.7 | 0.7 | 0.7 | 0.7 |
| Silicone surfactant DC 3225 | 0.3 | 0.3 | 0.3 | 0.3 | 0.3 |
| Sodium salt of a hydrogenated C16–18 fatty acid | 0.5 | 0.5 | 0.5 | 0.5 | 0.5 |
| Miscellaneous | BALANCE | BALANCE | BALANCE | BALANCE | BALANCE |

GRANULAR/POWDER PRODUCT FORMULATION EXAMPLES

Example I

The following compositions are in accordance with the invention.

| | A | B | C | D | E | F | G | H | I |
|---|---|---|---|---|---|---|---|---|---|
| Spray-dried Granules | | | | | | | | | |
| LAS | 10.0 | 10.0 | 15.0 | 5.0 | 5.0 | 10.0 | — | — | — |
| QAS | | | 1.0 | 1.0 | | | — | — | — |
| DTPA, HEDP and/or EDDS | 0.3 | 0.3 | 0.5 | 0.3 | | | — | — | — |
| MgSO4 | 0.5 | 0.5 | 0.1 | — | | | — | — | — |
| Sodium citrate | — | — | — | 3.0 | 5.0 | | — | — | — |
| Sodium carbonate | 10.0 | 10 | 15 | 10 | 7 | 10 | — | — | — |
| Sodium sulphate | 5.0 | 5.0 | — | — | 5.0 | 3.0 | — | — | — |
| Sodium silicate 1.6R | — | — | — | — | 2.0 | | — | — | — |
| Zeolite A | 16.0 | 18.0 | 20.0 | 20.0 | — | — | — | — | — |
| SKS-6 | — | — | — | 3.0 | 5.0 | — | — | — | — |
| MA/AA or AA | 1.0 | 2.0 | 11.0 | — | — | 2.0 | — | — | — |
| CHDM | 0.5 | 2.0 | 2.5 | 1.5 | 4.0 | 1.0 | — | — | — |
| QEA | 1.0 | — | — | — | 1.0 | — | — | — | — |
| Brightener | 0.05 | 0.05 | 0.05 | — | 0.05 | — | — | — | — |
| Silicone oil | 0.01 | 0.01 | 0.01 | — | — | 0.01 | — | — | — |
| Agglomerate | | | | | | | | | |
| LAS | | | — | — | — | — | 0.2 | 0.2 | 0.01 |
| $C_{45}AS$ | | | — | — | — | — | 2.0 | — | 1.0 |
| $AE_3$ | | | — | — | — | — | — | 1.0 | 0.5 |
| Carbonate | | | — | — | 4.0 | 1.0 | 1.0 | 1.0 | — |
| Sodium citrate | | | — | — | — | — | — | — | 5.0 |
| CFAA | | | | | — | — | — | — | — |
| Citric acid | | | — | — | — | 4.0 | — | 1.0 | 1.0 |
| QEA | | | — | — | — | 2.0 | 2.0 | 1.0 | — |
| SRP | | | — | — | — | 1.0 | 1.0 | 0.2 | — |
| Zeolite A | | | — | — | — | 15.0 | 26.0 | 15.0 | 16.0 |
| Sodium silicate | | | — | — | — | — | — | — | — |
| CHDM | — | — | — | — | — | — | 3.0 | — | — |
| Builder Agglomerates | | | | | | | | | |
| SKS-6 | 6.0 | — | — | — | 6.0 | 3.0 | — | 7.0 | 10.0 |
| LAS | 4.0 | 5.0 | — | — | 5.0 | 3.0 | — | 10.0 | 12.0 |

-continued

| | A | B | C | D | E | F | G | H | I |
|---|---|---|---|---|---|---|---|---|---|
| Dry-add particulate components | | | | | | | | | |
| Malic acid/carbonate/bicarbonate (40:20:40) | 8.0 | — | 10.0 | 4.0 | — | 8.0 | — | — | 4.0 |
| QEA | — | — | — | 0.2 | 0.5 | — | — | — | — |
| NACAOBS | 3.0 | — | — | 1.5 | — | — | — | 2.5 | — |
| NOBS | — | 3.0 | 3.0 | — | — | — | — | — | 5.0 |
| TAED | 2.5 | — | — | 1.5 | 2.5 | 6.5 | — | 1.5 | — |
| LAS (flake) | 10.0 | 10.0 | — | — | — | — | — | 8.0 | — |
| Spray-on | | | | | | | | | |
| Brightener | 0.2 | 0.2 | 0.3 | 0.1 | 0.2 | 0.1 | — | 0.6 | — |
| Dye | — | — | — | 0.3 | 0.05 | 0.1 | — | — | — |
| AE7 | — | — | — | — | — | 0.5 | — | 0.7 | — |
| Perfume | — | — | — | 0.8 | — | 0.5 | — | 0.5 | — |
| Dry-add | | | | | | | | | |
| Citrate | — | — | 20.0 | 4.0 | — | 5.0 | 15.0 | — | 5.0 |
| Percarbonate | 15.0 | 3.0 | 6.0 | 10.0 | — | — | — | 18.0 | 5.0 |
| Perborate | — | — | — | — | 6.0 | 18.0 | — | — | — |
| Photobleach | 0.02 | 0.02 | 0.02 | 0.1 | 0.05 | — | 0.3 | — | 0.03 |
| Enzymes (cellulase, amylase, protease, lipase) | 1.3 | 0.3 | 0.5 | 0.5 | 0.8 | 2.0 | 0.5 | 0.16 | 0.2 |
| Carbonate | 0.0 | 10.0 | — | — | — | 5.0 | 8.0 | 10.0 | 5.0 |
| Perfume (encapsulated) | 0.6 | 0.5 | 0.5 | — | 0.3 | 0.5 | 0.2 | 0.1 | 0.6 |
| Suds suppressor | 1.0 | 0.6 | 0.3 | — | 0.10 | 0.5 | 1.0 | 0.3 | 1.2 |
| Soap | 0.5 | 0.2 | 0.3 | 3.0 | 0.5 | — | — | 0.3 | — |
| Citric acid | — | — | — | 6.0 | 6.0 | — | — | — | 5.0 |
| Dyed carbonate (blue, green) | 0.5 | 0.5 | 1.0 | 2.0 | — | 0.5 | 0.5 | 0.5 | 1.0 |
| SKS-6 | — | — | — | 4.0 | — | — | — | 6.0 | — |
| Fillers up to 100% | | | | | | | | | |

The compositions exemplified above have at least 90% by weight of particles having a geometric mean particle diameter of from about 850 microns with a geometric standard deviation of from about 1.2. Unexpectedly, the compositions have improved aesthetics, flowability and solubility.

TABLET PRODUCT FORMULATION EXAMPLES

Example 1a i) A detergent base powder of composition A (see table 1) was prepared as follows: all the particulate materials of base composition A were mixed together in a mixing drum to form a homogenous particulate mixture.

ii) I part of polyethyleneglycol was sprayed onto 99 parts of base powder of composition A while mixing.

iii) Tablets were then made the following way. 54 g of the mixture was introduced into a mould of circular shape with a diameter of 5.5 cm and compressed at a force of 2.0 kN with an Instron 4464 press. The tablet tensile strength (or diametrical fracture stress) obtained at this force was 19.2 kPa. Means to assess tablet strength (also referred to as diametrical fracture stress) are given in Pharmaceutical dosage forms: tablets volume 1 Ed. H. A. Lieberman et al, published in 1989.

Example 1b i) The same composition A was prepared following the same process as in example 1a.

ii) 0.9 parts of polyethyleneglycol and 0.1 part of 1,4 cyclohexanedimethanol were mixed together and sprayed onto 99 parts of base powder of composition A while mixing.

iii) Tablets were then made following the same way as described in example 1a. The tablet tensile strength (or diametrical fracture stress) obtained at a force of 2.0 kN was 23.6 kPa.

Examples 2a–3b were prepared in an analogous fashion to the process described above and according to the formulation compositions detailed below.

TABLE 1

| | Composition A (%) | Composition B (%) | Composition C (%) |
|---|---|---|---|
| Anionic agglomerates[1] | 34 | 34 | 34 |
| Nonionic agglomerates[2] | 9.57 | 9.57 | 9.57 |
| Layered silicate[3] | 2.7 | 1.5 | 1.5 |
| Sodium percarbonate | 12.43 | 12.43 | 12.43 |
| Bleach activator agglomerates[4] | 6.48 | 6.48 | 6.48 |
| Sodium carbonate | 19.01 | 18.96 | 18.46 |
| EDDS/Sulphate particle[5] | 0.50 | 0.50 | 0.50 |
| Tetrasodium salt of Hydroxyethane Diphosphonic acid | 0.8 | 0.8 | 0.8 |
| Fluorescer | 0.11 | 0.11 | 0.11 |
| Zinc Phthalocyanine sulphonate encapsulate[6] | 0.027 | 0.027 | 0.027 |
| Soap powder | 1.49 | 0.74 | 0.74 |
| Suds suppressor[7] | 1.8 | 1.8 | 1.8 |
| Citric acid | 7.51 | 7.51 | 7.51 |
| Protease | 0.8 | 0.8 | 0.8 |
| Cellulase | 0.16 | 0.16 | 0.16 |
| Amylase | 0.61 | 0.61 | 0.61 |
| Polyethylene glycol MW of 4000 flakes | — | 1.5 | 1.5 |
| Sodium salt of Linear Alkyl Benzene Sulphonate/DiIsoPropylBenzeneSulphonate[8] | 1 | 1 | 1.5 |

[1]Anionic agglomerates comprise 37% anionic surfactant, 2% cationic surfactant, 22% layered silicate, 10% acetate, 6% carbonate and 23% zeolite.

[2]Nonionic agglomerates comprise of 24% nonionic surfactant, 6% ethoxylated hexamethylene diaminequat, 40% acetate/zeolite mix, 20% carbonate and 10% zeolite.

[3]Layered silicate comprises of 95% SKS 6 and 5% silicate.

[4]Bleach activator agglomerates comprise of 81% TAED, 17% acrylic/maleic copolymer (acid form) and 2% water.

TABLE 1-continued

| | Composition A (%) | Composition B (%) | Composition C (%) |
|---|---|---|---|

[5]Ethylene diamine N,N-disuccinic acid sodium salt/Sulphate particle comprise of 58% of Ethylene diamine N,N-disuccinic acid sodium salt, 23% of sulphate and 19% water.
[6]Zinc phthalocyanine sulphonate encapsulates are 10% active.
[7]Suds suppressor comprises of 11.5% silicone oil (ex Dow Corning); 59% of zeolite and 29.5% of water.
[8]Sodium salt of Linear Alkyl Benzene Sulphonate/DiIsoPropylBenzeneSulphonate comprises of 67% Linear Alkyl Benzene Sulphonate and 33% DiIsoPropylBenzeneSulphonate.

A tablet binder composition was sprayed onto the above detergent base powders according to the following compositions:

TABLE 2

| | Example 1a | Example 1b | Example 2a | Example 2b | Example 3a | Example 3b |
|---|---|---|---|---|---|---|
| Powder A | 99% | 99% | | | | |
| Powder B | | | 98.5% | 98.5% | | |
| Powder C | | | | | 98.5% | 98.5% |
| Polyethylene-glycol | 1% | 0.9% | 1.50% | 1.35% | 1.5% | 1.3% |
| 1,4 cyclohexane-dimethanol | | 0.1% | | 0.15% | | 0.2% |

The strength of the tablets was then tested as has been described above in step iii) and elsewhere in the present invention:

TABLE 3

| | Example 1a | Example 1b | Example 2a | Example 2b | Example 3a | Example 3b |
|---|---|---|---|---|---|---|
| Tablet tensile strength (kPa) | 19.2 | 23.6 | 12.4 | 14.7 | 16 | 19 |

The tensile strength of the tablet samples which contained CHDM were greater than the CHDM tablet samples of virtually identical composition, but which contained no CHDM.

The operating window was also assessed:

TABLE 4

| | Example 3a | Example 3b |
|---|---|---|
| Density at a tablet hardness of 5.5 kp | 1035 | 1010 |
| Density at a tablet dispensing of 15% | 1052 | 1035 |

The operating window of the tablet samples which contained CHDM (width=25 g/liter) was broader than the operating window of the tablet samples which contained no CHDM (width=17 g/liter).

The amount of dispensing of a detergent tablet as tabulated above in table 4 can be determined through an experimental test which measures the amount of detergent product dispensed during an automatic wash process in the following way:

1. Two tablets, nominally 50 grams each, are weighed, and then placed in the dispenser of a Baucklnecht® WA9850 washing machine. The water supply to the washing machine is set to a temperature of 20° C. and a hardness of 21 grains per gallon, the dispenser water inlet flow-rate being set to 8 l/min.
2. The level of tablet residues left in the dispenser is checked by switching the washing on and the wash cycle set to wash program 4 (white/colors, short cycle).
3. The dispensing percentage residue is then determined as follows:

% dispensing=residue weight×100/original tablet weight

The level of residues is determined by repeating the procedure 10 times and an average residue level is calculated based on the ten individual measurements.

Having thus described the invention in detail, it will be clear to those skilled in the art that various changes may be made without departing from the scope of the invention and the invention is not to be considered limited to what is described in the specification.

What is claimed is:

1. A non-aqueous liquid laundry detergent composition comprising:

A) from about 49% to about 99.95% by weight of the composition of a surfactant-containing non-aqueous liquid phase; and B) from about 1% to about 50% by weight of the composition of a particulate material which is substantially insoluble in said liquid phase and which is selected from the group consisting of peroxygen bleaching agents, bleach activators, organic detergent builders, inorganic alkalinity sources, enzymes, brighteners, polymers and mixtures thereof; and C) a hydrotrope wherein the hydrotrope comprises 1, 4 Cyclo Hexane Di Methanol, and wherein the composition comprises no quaternary compounds which are derivatives of any of the following: $C_{16-18}$ unsaturated fatty acids, methyl diethanolamine or methyl chloride.

2. A non-aqueous liquid detergent composition according to claim 1, wherein the detergent composition includes from about 0.01% to about 10% by weight of the composition of a fabric care agent.

3. A non-aqeous liquid detergent composition according to claim 1, wherein the surfactant-containing non-aqueous liquid phase has a density of from about 0.6 to 1.4 g/cc.

4. A non-aqueous liquid detergent composition according to claim 1, wherein the particulate material has a particle size of from about 0.1 to 1500 microns.

5. A non-aqueous liquid detergent composition according to claim 1 further comprising microspheres having a median particle size of from 10 $\mu$m to 150 $\mu$m.

6. A non-aqueous liquid detergent composition according to claim 5 comprising microspheres having an average density of from 0.1 g/ml to 1.8 g/ml.

7. A method of laundering soiled fabrics comprising contacting said fabric in an aqueous laundering solution with a nonaqueous liquid detergent composition according to claim 1.

8. A method of laundering soiled fabrics comprising contacting said fabrics in an aqueous laundering solution with a non aqueous liquid a detergent composition according to claim 2.

* * * * *